US012130016B1

(12) United States Patent
Nath et al.

(10) Patent No.: US 12,130,016 B1
(45) Date of Patent: Oct. 29, 2024

(54) TURBINE ENGINE INCLUDING A COMBUSTOR

(71) Applicant: General Electric Company, Schenectady, NY (US)

(72) Inventors: Hiranya Nath, Bengaluru (IN); Clayton S. Cooper, Loveland, OH (US); Steven C. Vise, Loveland, OH (US); Michael A. Benjamin, Cincinnati, OH (US); Pradeep Naik, Bengaluru (IN); Ranganatha Narasimha Chiranthan, Bengaluru (IN); Perumallu Vukanti, Bengaluru (IN); Sibtosh Pal, Mason, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/326,647

(22) Filed: May 31, 2023

(51) Int. Cl.
*F23R 3/12* (2006.01)
*F23R 3/46* (2006.01)

(52) U.S. Cl.
CPC . *F23R 3/12* (2013.01); *F23R 3/46* (2013.01)

(58) Field of Classification Search
CPC ..... F23R 3/02; F23R 3/12; F23R 3/34; F23R 3/346; F23R 3/42; F23R 3/46; F23R 3/50; F23R 3/52; F23R 3/58; F23R 2900/00015
See application file for complete search history.

(56) References Cited

U.S. PATENT DOCUMENTS

| | | | | |
|---|---|---|---|---|
| 4,982,570 | A | 1/1991 | Waslo et al. | |
| 5,295,354 | A * | 3/1994 | Barbier | F23R 3/54 60/731 |
| 5,619,855 | A | 4/1997 | Burrus | |
| 6,286,298 | B1 | 9/2001 | Burrus et al. | |
| 6,481,209 | B1 * | 11/2002 | Johnson | F23R 3/346 60/750 |
| 6,951,108 | B2 | 10/2005 | Burrus et al. | |
| 7,779,866 | B2 | 8/2010 | Grammel, Jr. et al. | |
| 7,849,693 | B2 | 12/2010 | Bainville et al. | |
| 9,068,748 | B2 | 6/2015 | Hoke | |
| 9,068,751 | B2 | 6/2015 | Snyder | |
| 9,797,601 | B2 | 10/2017 | Cheung et al. | |
| 9,958,162 | B2 | 5/2018 | Dai et al. | |
| 10,060,629 | B2 | 8/2018 | Kim et al. | |

(Continued)

*Primary Examiner* — Scott J Walthour
(74) *Attorney, Agent, or Firm* — Venable LLP; Peter T. Hrubiec; Michele V. Frank

(57) ABSTRACT

A combustor for a turbine engine includes a main combustion chamber, an annular dome, and a secondary combustion chamber positioned downstream of the annular dome. A plurality of first mixing assemblies are disposed through the annular dome and include a pilot mixer. The pilot mixer injects a pilot mixer fuel-air mixture axially into the main combustion chamber and generates a first recirculation zone within the main combustion chamber. A plurality of second mixing assemblies are disposed at the secondary combustion chamber axially aft of the first mixing assemblies and include a main mixer. The main mixer injects a main mixer fuel-air mixture into the secondary combustion chamber to produce combustion gases and to generate a second recirculation zone within the secondary combustion chamber axially aft of the first recirculation zone. The secondary combustion chamber injects the combustion gases into the main combustion chamber.

20 Claims, 12 Drawing Sheets

(56) References Cited

U.S. PATENT DOCUMENTS

| | | | | |
|---|---|---|---|---|
| 10,330,320 | B2 | 6/2019 | Snyder, III | |
| 10,330,321 | B2 | 6/2019 | Snyder | |
| 10,823,422 | B2 | 11/2020 | Johnson et al. | |
| 10,976,053 | B2 | 4/2021 | Boardman et al. | |
| 11,073,286 | B2 | 7/2021 | Boardman et al. | |
| 2002/0017101 | A1* | 2/2002 | Schilling | F23R 3/06 60/752 |
| 2002/0108378 | A1* | 8/2002 | Ariyoshi | F23R 3/007 60/800 |
| 2013/0125550 | A1* | 5/2013 | Prade | F23R 3/28 60/740 |
| 2013/0145766 | A1* | 6/2013 | Hawie | F23R 3/16 60/740 |
| 2016/0116169 | A1 | 4/2016 | Hyland et al. | |
| 2016/0123596 | A1 | 5/2016 | Hoke et al. | |
| 2016/0258627 | A1 | 9/2016 | Cheung et al. | |
| 2016/0320063 | A1 | 11/2016 | Dai et al. | |
| 2017/0363004 | A1 | 12/2017 | Xu | |
| 2018/0094590 | A1 | 4/2018 | Proscia | |
| 2018/0094814 | A1 | 4/2018 | Proscia | |
| 2018/0094817 | A1 | 4/2018 | Proscia | |
| 2018/0156463 | A1 | 6/2018 | Dai et al. | |
| 2018/0156464 | A1 | 6/2018 | Dai et al. | |
| 2018/0163629 | A1 | 6/2018 | Proscia | |

* cited by examiner

TURBINE ENGINE INCLUDING A COMBUSTOR

TECHNICAL FIELD

The present disclosure relates generally to turbine engines including combustors.

BACKGROUND

A turbine engine generally includes a fan and a core section arranged in flow communication with one another. A combustor is arranged in the core section to generate combustion gases for driving a turbine of the turbine engine.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
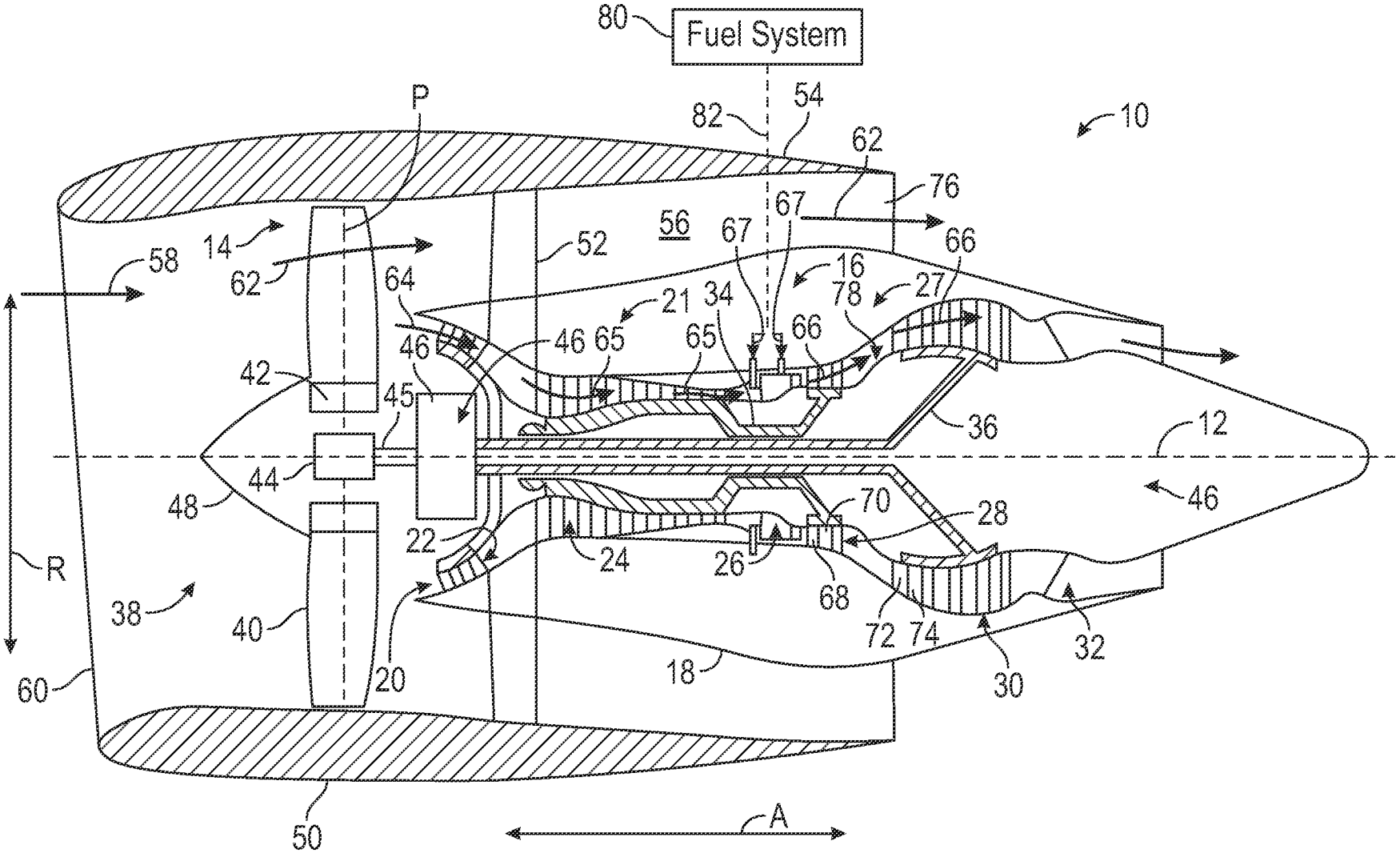
FIG. 1 is a schematic cross-sectional diagram of a turbine engine, taken along a longitudinal centerline axis of the turbine engine, according to the present disclosure.

Additional features, advantages, and embodiments of the present disclosure are set forth or apparent from a consideration of the following detailed description, drawings, and claims. Moreover, both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and the scope of the present disclosure.

As used herein, the terms "first," "second," and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the terms "low," "mid" (or "mid-level"), and "high," or their respective comparative degrees (e.g., "lower" and "higher", where applicable), when used with compressor, turbine, shaft, fan, or turbine engine components, each refers to relative pressures, relative speeds, relative temperatures, and/or relative power outputs within an engine unless otherwise specified. For example, a "low power" setting defines the engine configured to operate at a power output lower than a "high power" setting of the engine, and a "mid-level power" setting defines the engine configured to operate at a power output higher than a "low power" setting and lower than a "high power" setting. The terms "low," "mid" (or "mid-level") or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine.

The various power levels of the turbine engine detailed herein are defined as a percentage of a sea level static (SLS) maximum engine rated thrust. Low power operation includes, for example, less than thirty percent (30%) of the SLS maximum engine rated thrust of the turbine engine. Mid-level power operation includes, for example, thirty percent (30%) to eighty-five (85%) of the SLS maximum engine rated thrust of the turbine engine. High power operation includes, for example, greater than eighty-five percent (85%) of the SLS maximum engine rated thrust of the turbine engine. The values of the thrust for each of the low power operation, the mid-level power operation, and the high power operation of the turbine engine are exemplary only, and other values of the thrust can be used to define the low power operation, the mid-level power operation, and the high power operation.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

Combustors for turbine engines, such as turbine engines for aircraft, ignite fuel and air mixtures to produce combustion gases, which in turn drive one or more turbines of the turbine engine, thereby rotating one or more loads (e.g., a fan, a propeller, etc.). Air pollution concerns have led to stricter combustion emissions standards. Such standards regulate the emission of nitrogen oxide ($NO_x$), non-volatile particulate matter (nvPM), as well as other types of exhaust emissions, from the turbine engine. The nvPM includes, for example, soot, smoke, or the like. Generally, $NO_x$ is formed during the combustion process due to high flame temperatures in the combustor. Turbine engine design tradeoffs are necessary to meet requirements for noise, emissions, fuel burn, cost, weight, and performance. As temperatures in the combustor increase, $NO_x$ generation increases due to the higher temperatures. In turbine engine design, balancing a reduction in $NO_x$ emissions, nvPM emissions, $CO_2$, and noise, while achieving improved engine performance, is difficult. For example, combustor design changes to achieve lower emissions must not impact the ability of the combustion system to satisfy performance and certification requirements throughout the operating cycle of the aircraft. Further, high bypass ratio turbine engines (e.g., bypass ratios greater than 9.0) require high fuel-air ratios and need multiple fuel-staging to meet $NO_x$ requirements.

Variations of two combustor architectures are used in turbine engine design to balance operational and environmental requirements: a rich-quench lean (RQL) combustor and a lean burn combustor. The RQL combustor operates as fuel-rich (e.g., excess fuel) mixture in a front-end primary zone that is directly downstream of the fuel injector and the swirler and provides flame stability over the range of combustor operation. As the fuel-rich mixture moves axially in the combustor, air jets are used to help close the primary zone recirculation zone and to provide additional air to continue reactions and also to quench the combustion gas to a lean mixture to reduce $NO_x$ emissions and to reduce the highest temperature before the mixture exits the combustor. For example, the additional air from the air jets increases the amount of air in the fuel-air mixture changing the mixture from fuel-rich to fuel-lean. RQL combustors produce great amounts of soot in the fuel-rich primary zone, but $NO_x$ is reduced due to temperatures being low for fuel-rich mixtures. A rapid RQL quench zone design is needed in RQL combustors to balance a reduction of combustor hot spots and time at a temperature at which $NO_x$ is formed, while providing adequate temperature and time to burn out the soot and the nvPM formed in the primary zone.

Lean burn combustors avoid the high $NO_x$ formation zone resulting from high temperatures by starting lean and remaining lean at higher power outputs of the turbine engine. A small, fuel-rich flame, referred to as a pilot flame, is used that operates with a lower percentage of the total fuel and stabilizes the flame when in a lean burning mode. The pilot provides all of the fuel during low-power operation and part-power operation to maintain improved combustion efficiencies, and a main fuel circuit is opened to produce a main flame for higher power operation or mid-level power operation. Thus, the flame during the mid-level power operation and/or during the higher power operation includes the pilot flame and the main flame. A lean burn design provides all of the mixing in the front-end (e.g., the upstream end) of the combustor, which helps to reduce nvPM emissions by remaining fuel-lean and avoiding large combustor volumes of fuel-rich, high nvPM-producing zones in the combustor. When operating on pilot only flow at lower powers, the lean burn combustor produces non-zero nvPM as the pilot rich flame is quenched by the main air flow, similar to the RQL combustor.

As detailed above, there are tradeoffs in balancing $NO_x$ emissions, nvPM emissions, carbon monoxide (CO) and unburned hydrocarbon (UHC) emissions in the combustion chamber. $NO_x$ is produced at high engine power levels, and the $NO_x$ is produced in the post-flame region of the combustion chamber, is temperature driven, and is time at temperature driven. For example, a greater amount of $NO_x$ is produced at higher temperatures and longer times at temperature. Current turbine engines control $NO_x$ emissions by reducing peak combustor temperatures and combustor residence time at those high temperatures. Reducing combustor residence time and combustor volume and length have the added benefit of reduced engine weight. For short combustor residence times and low combustion temperatures where $NO_x$ formation is low, however, CO and UHC emissions are higher due to incomplete combustion, and the combustor liner cooling air during low power ground operations can quench reactions of CO and UHC. Fuel-rich zones in the combustor form nvPM emissions, and increased time (combustor volume) is needed to oxidize the nvPM before being quenched in the downstream cooler region of the engine after exiting the combustor. Therefore, to balance all emissions requirements, turbine engine designs need an improved fuel and air placement in the dome region, an improved stoichiometry in the combustor, and improved residence time. Some turbine engines utilize leaner mixtures or changes in fuel spray at the upstream end of the combustor to reduce nvPM emissions. Such turbine engines, however, lacks optimum stoichiometry in the combustor at high fuel-air ratios at advanced engine thermodynamic cycles to reduce $NO_x$ emissions. Further, higher fuel-to-air ratios (e.g., greater than 0.031) at take-off are needed in such advanced engine thermodynamic cycles. Current combustor designs that utilize axial staging, traditional trapped vortex cavities, or the like, that utilize lower fuel-to-air ratios (e.g., less than or equal to 0.031) at take-off do not adequately optimize the stoichiometry of the combustor to meet the required $NO_x$ emissions targets when the fuel-to-air ratio is increased to the aforementioned higher fuel-to-air-ratios.

Embodiments of the present disclosure provide systems and methods to balance the requirements in turbine engines of low fuel burn and carbon dioxide ($CO_2$) emissions that are achieved with combustor fuel-air ratios, and other pollutant emissions, such as $NO_x$ emissions, that increase with temperature increases. Such a reduction in the various types of emissions is difficult to achieve when fuel burn and emissions need to be reduced over an entirety of a mission cycle of the turbine engine of an aircraft. The mission cycle includes low power operation, mid-level power operation, and high power operation. Low power operation includes, for example, engine start, idle, taxiing, and approach. Mid-level power operation includes, for example, cruise. High power operation includes, for example, takeoff and climb.

Embodiments of the present disclosure utilize a lean burn staged combustion system. Thus, the present disclosure provides for a multi-staged combustor for low $NO_x$ emissions (e.g., at least 50% below the regulations in the eleventh meeting of the Committee on Aviation Environmental Protection (CAEP/11) of the International Civil Aviation Organization (ICAO). For example, the multi-staged combustor includes both radial staging and axial staging of the fuel. The multi-staged combustor includes a nested flame structure produced by a first mixing assembly that includes a pilot mixer and a first main mixer encircling the pilot mixer for radial fuel staging and air staging. For example, the pilot mixer injects the fuel and the air axially from the pilot mixer and into a main combustion chamber, and the first main mixer, located radially outward of the pilot mixer, injects the fuel and the air radially from the first main mixer and into the main combustion chamber. The first mixing assembly is located at the annular dome that is positioned at a forward end (e.g., an upstream end) of the main combustion chamber. The first mixing assembly includes an air swirler that swirls the compressed air and generates a first recirculation zone within the main combustion chamber.

The multi-staged combustor also includes a secondary combustion chamber (e.g., a combustion chamber that is smaller than the main combustion chamber) positioned axially aft, or axially downstream, of the first mixing assembly. The secondary combustion chamber is formed in the outer liner or the inner liner of the combustor and includes a second mixing assembly that produces an auxiliary flame and includes a second main mixer disposed through the outer liner or the inner liner at the secondary combustion chamber. The second main mixer is disposed through the outer liner and/or the inner liner to inject fuel and air into the secondary combustion chamber. The secondary combustion chamber includes an air swirler and a fuel nozzle disposed through the outer liner or the inner liner at the secondary combustion chamber. In one embodiment, the fuel is injected into the secondary combustion chamber at an aft stagnation region of a second recirculation zone to provide increased flame stability as compared to combustors without the benefit of the present disclosure. Accordingly, the present disclosure provides for lean combustion within both the main combustion chamber and even leaner combustion within the secondary combustion chamber. The secondary combustion chamber injects the combustion gases generated in the secondary combustion chamber into the main combustion chamber for flame stability and a reduction in $NO_x$ emissions as compared to combustors without the benefit of the present disclosure.

The first mixing assembly injects the fuel and the air into the first recirculation zone, the second mixing assembly injects the fuel and the air into the secondary combustion chamber, and the secondary combustion chamber injects the combustion gases into the main combustion chamber in an area that is located axially aft, or axially downstream, of the first recirculation zone. The nested flame provides lean combustion, and the combustion gases from the secondary combustion chamber that are injected downstream of the nested flame provides added flexibility of having even leaner combustion to reduce $NO_x$ emissions further than combustors without the benefit of the present disclosure (e.g., combustors with axial staging only and/or with only a secondary combustion chamber axially aligned with the first combustion zone, for example, formed partially by the annular dome). In this way, the radial staging (e.g., provided by the pilot mixer and the first main mixer) and the axial staging (e.g., provided by the secondary combustion chamber) combined provides for improved stoichiometric capabilities in the combustor, while reducing $NO_x$ emissions, across the entire mission operating cycle of a turbine engine.

The secondary combustion chamber can include a plurality of secondary combustion chambers such that each secondary combustion chamber defines a discrete combustion chamber therein. In some embodiments, the secondary combustion chamber is a singular, annular continuous cavity with a plurality of second mixing assemblies spaced circumferentially about the secondary combustion chamber. In some embodiments, the outer liner and/or the inner liner can include combustion holes and/or dilution holes provided upstream and/or downstream of the second main mixer for providing additional air into the main combustion chamber and/or into the secondary combustion chamber for the combustion process.

At a low power engine operation, only the pilot mixer is used to produce a pilot flame. In some embodiments, both the pilot mixer and the first main mixer can be used during a low power engine operation and the fuel and the air can be radially staged between the pilot mixer and the first main mixer for flame stability and/or to avoid lean blowout (LBO). At a mid-power engine operation or a high power engine operation, the pilot mixer, the first main mixer, and the second main mixer are operational at all operating conditions, and the fuel splits and air splits are controlled to achieve combustion efficiency, reduced emissions, and improved operability of the combustor, as compared to combustors without the benefit of the present disclosure. The second recirculation zone can be co-rotating or counter-rotating with the first recirculation zone. In some embodiments, the plurality of first mixing assemblies includes only a pilot mixer such that the combustor is a rich burn dome. In this way, the plurality of first mixing assemblies provides a fuel-rich mixture in the first recirculation zone (e.g., in an area of the annular dome) within the main combustion chamber and the plurality of second mixing assemblies provides a fuel-lean mixture in the second recirculation zone within the secondary combustion chamber. The outer liner and the inner liner can be any shape, with split liner designs. The fuel can be any type of fuel used for turbine engines, such as, for example, JetA, sustainable aviation fuels (SAF) including biofuels, hydrogen-based fuel (H2), or the like.

Referring now to the drawings, FIG. 1 is a schematic cross-sectional diagram of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference) and a radial direction R that is normal to the axial direction A. In general, the turbine engine 10 includes a fan section 14 and a core turbine engine 16 disposed downstream from the fan section 14.

The core turbine engine 16 depicted generally includes an outer casing 18 that is substantially tubular and defines an annular inlet 20. As schematically shown in FIG. 1, the outer casing 18 encases, in serial flow relationship, a compressor section 21 including a booster or a low pressure (LP) compressor 22 followed downstream by a high pressure (HP) compressor 24, a combustion section 26, a turbine section 27 including a high pressure (HP) turbine 28 followed downstream by a low pressure (LP) turbine 30, and a jet exhaust nozzle section 32. A high pressure (HP) shaft 34 or a spool drivingly connects the HP turbine 28 to the HP compressor 24 to rotate the HP turbine 28 and the HP compressor 24 in unison. A low pressure (LP) shaft 36 drivingly connects the LP turbine 30 to the LP compressor 22 to rotate the LP turbine 30 and the LP compressor 22 in unison. The compressor section 21, the combustion section 26, the turbine section 27, and the jet exhaust nozzle section 32 together define a core air flow path.

For the embodiment depicted in FIG. 1, the fan section 14 includes a fan 38 (e.g., a variable pitch fan) having a plurality of fan blades 40 coupled to a disk 42 in a spaced apart manner. As depicted in FIG. 1, the fan blades 40 extend outwardly from the disk 42 generally along the radial direction R. Each fan blade 40 is rotatable relative to the disk 42 about a pitch axis P by virtue of the fan blades 40 being operatively coupled to an actuation member 44 configured to collectively vary the pitch of the fan blades 40 in unison. The fan blades 40, the disk 42, and the actuation member 44 are together rotatable about the longitudinal centerline axis 12 via a fan shaft 45 that is powered by the LP shaft 36 across a power gearbox, also referred to as a gearbox assembly 46. The gearbox assembly 46 is shown schematically in FIG. 1. The gearbox assembly 46 includes a plurality of gears for adjusting the rotational speed of the fan shaft 45 and, thus, the fan 38 relative to the LP shaft 36.

Referring still to the exemplary embodiment of FIG. 1, the disk 42 is covered by a rotatable fan hub 48 aerodynamically contoured to promote an airflow through the plurality of fan blades 40. In addition, the fan section 14 includes an annular fan casing or a nacelle 50 that circumferentially surrounds the fan 38 and/or at least a portion of the core turbine engine 16. The nacelle 50 is supported relative to the core turbine engine 16 by a plurality of circumferentially spaced outlet guide vanes 52. Moreover, a downstream section 54 of the nacelle 50 extends over an outer portion of the core turbine engine 16 to define a bypass airflow passage 56 therebetween.

During operation of the turbine engine 10, a volume of air 58 enters the turbine engine 10 through an inlet 60 of the nacelle 50 and/or the fan section 14. As the volume of air 58 passes across the fan blades 40, a first portion of air 62 is directed or routed into the bypass airflow passage 56, and a second portion of air 64 is directed or is routed into the upstream section of the core air flow path, or, more specifically, into the annular inlet 20 of the LP compressor 22. The ratio between the first portion of air 62 and the second portion of air 64 is commonly known as a bypass ratio. The pressure of the second portion of air 64 is then increased, forming compressed air 65, and the compressed air 65 is routed through the HP compressor 24 and into the combustion section 26, where the compressed air 65 is mixed with fuel and burned to provide combustion gases 66.

The combustion gases 66 are routed into the HP turbine 28 and expanded through the HP turbine 28 where a portion of thermal energy and/or kinetic energy from the combustion gases 66 is extracted via sequential stages of HP turbine stator vanes 68 that are coupled to the outer casing 18 and HP turbine rotor blades 70 that are coupled to the HP shaft 34, thus, causing the HP shaft 34 to rotate, thereby supporting operation of the HP compressor 24. The combustion gases 66 are then routed into the LP turbine 30 and expanded through the LP turbine 30. Here, a second portion of the thermal energy and/or kinetic energy is extracted from the combustion gases 66 via sequential stages of LP turbine stator vanes 72 that are coupled to the outer casing 18 and LP turbine rotor blades 74 that are coupled to the LP shaft 36, thus, causing the LP shaft 36 to rotate, thereby supporting operation of the LP compressor 22 and rotation of the fan 38 via the gearbox assembly 46.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before being exhausted from a fan nozzle exhaust section 76 of the turbine engine 10, also providing propulsive thrust. The HP turbine 28, the LP turbine 30, and the jet exhaust nozzle section 32 at least partially define a hot gas path 78 for routing the combustion gases 66 through the core turbine engine 16.

As detailed above, the second portion of air 64 is mixed with fuel 67 in the combustion section 26 to produce the combustion gases 66. The turbine engine 10 also includes a fuel system 80 for providing the fuel 67 to the combustion section 26. The fuel system 80 includes a fuel tank (not shown) for storing fuel therein and one or more fuel injector lines 82 to provide the fuel 67 to the combustion section 26, as detailed further below.

The turbine engine 10 depicted in FIG. 1 is by way of example only. In other exemplary embodiments, the turbine engine 10 may have any other suitable configuration. For example, in other exemplary embodiments, the fan 38 may be configured in any other suitable manner (e.g., as a fixed pitch fan) and further may be supported using any other suitable fan frame configuration. Moreover, in other exemplary embodiments, any other suitable number or configuration of compressors, turbines, shafts, or a combination thereof may be provided. In still other exemplary embodiments, aspects of the present disclosure may be incorporated into any other suitable turbine engine, such as, for example, turbofan engines, propfan engines, turbojet engines, turboprop, and/or turboshaft engines.

Figure 2:
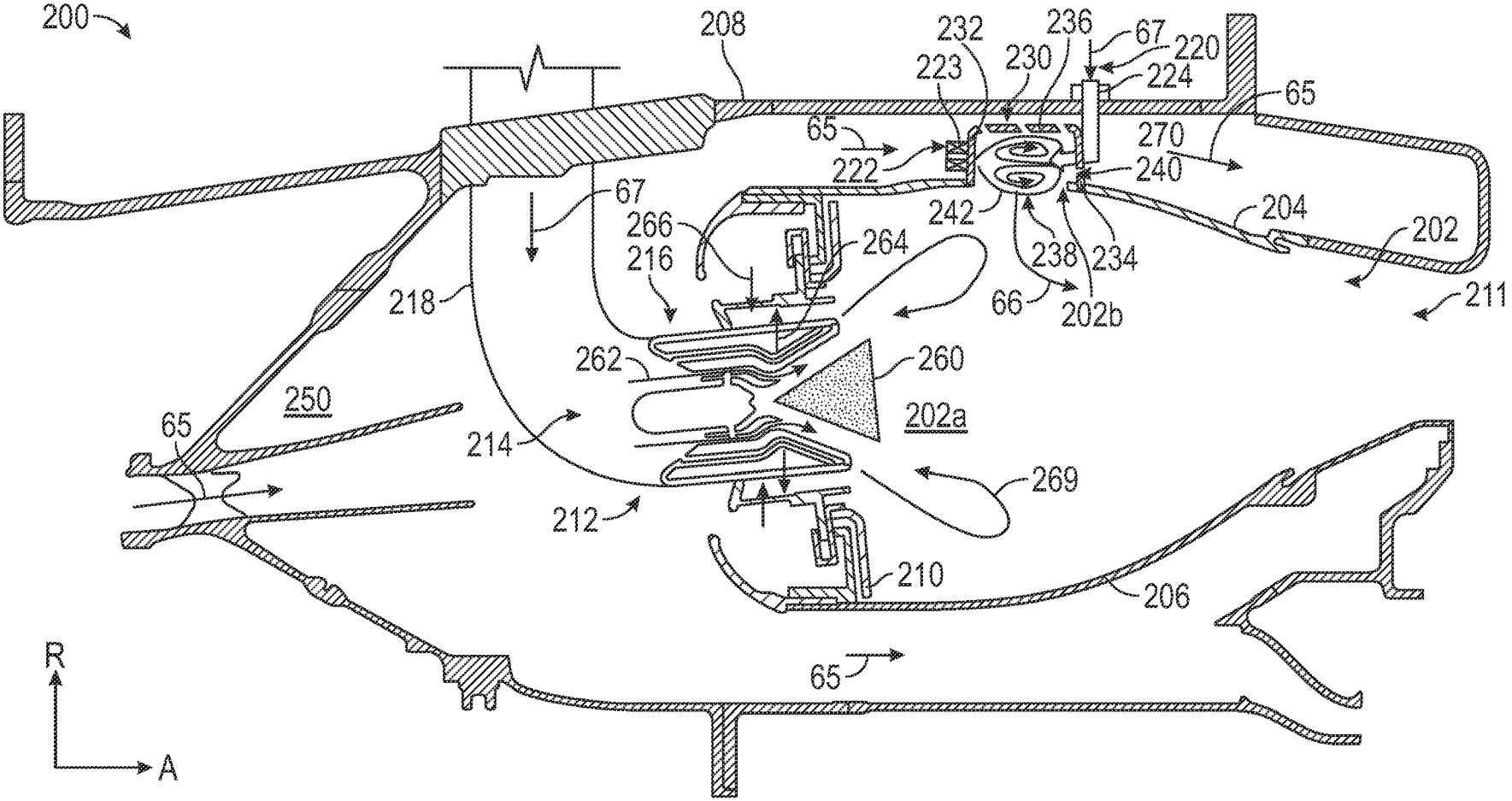
FIG. 2 is a schematic cross-sectional diagram of a combustor for the turbine engine of FIG. 1, taken along a longitudinal centerline axis of the turbine engine, according to the present disclosure.

FIG. 2 is a schematic cross-sectional diagram of a combustor 200 for the turbine engine 10 (FIG. 1), taken along a longitudinal centerline axis 12 of the turbine engine 10 (FIG. 1), according to the present disclosure. In the exemplary embodiment, the combustion section 26 (FIG. 1) includes the combustor 200 having a main combustion chamber 202 defined by an outer liner 204 and an inner liner 206. The outer liner 204 and the inner liner 206 are annular about the longitudinal centerline axis 12 of the turbine engine 10 (FIG. 1). The outer liner 204 defines a radially outer boundary of the main combustion chamber 202, and the inner liner 206 defines a radially inner boundary of the main combustion chamber 202. The outer liner 204 and the inner liner 206 are spaced radially inward from an annular combustor casing 208 that extends circumferentially about the outer liner 204 and the inner liner 206. The combustor 200 also includes an annular dome 210 mounted upstream from the outer liner 204 and the inner liner 206. The annular dome 210 defines an upstream end of the main combustion chamber 202. The main combustion chamber 202 extends from the annular dome 210 to a combustion chamber outlet 211.

A plurality of first mixing assemblies 212 (only one is illustrated in FIG. 2) are spaced circumferentially about the annular dome 210 to deliver a first mixture of fuel and air to the main combustion chamber 202. For example, the plurality of first mixing assemblies 212 deliver the first mixture of fuel and air into a first recirculation zone 202*a* of the main combustion chamber 202, as detailed further below. In FIG. 2, each first mixing assembly 212 is a twin annular premixing swirler (TAPS) that includes a pilot mixer 214 and a first main mixer 216. The first main mixer 216 is concentrically aligned with respect to the pilot mixer 214 and extends circumferentially about the pilot mixer 214. A plurality of first fuel injectors 218 (only one is illustrated in FIG. 2) are coupled in flow communication with each respective first mixing assembly 212. The plurality of first fuel injectors 218 are spaced circumferentially about the annular dome 210 and extend axially from the annular combustor casing 208 to the plurality of first mixing assemblies 212.

A plurality of second mixing assemblies 220 (only one illustrated in FIG. 2) are spaced circumferentially about the outer liner 204 to deliver a second mixture of fuel and air to a secondary combustion chamber 230, detailed further below. For example, the plurality of second mixing assemblies 220 deliver the second mixture of fuel and air into a second recirculation zone 202*b* of the secondary combustion chamber 230, as detailed further below. The second recirculation zone 202*b* is located axially aft of the first recirculation zone 202*a*. In this way, the second recirculation zone 202*b* is located downstream of the first recirculation zone 202*a*. Each of the plurality of second mixing assemblies 220 includes a second main mixer 222. The second main mixer 222 includes a secondary combustion chamber air swirler 223 that swirls the compressed air 65 in the second recirculation zone 202*b*, as detailed further below. A plurality of second fuel injectors 224 (only one is illustrated in FIG. 2) are coupled in flow communication with each respective second mixing assembly 220. The plurality of second fuel injectors 224 are spaced circumferentially about the outer liner 204 and extend axially from the annular combustor casing 208 to the plurality of second mixing assemblies 220.

The secondary combustion chamber 230 is formed in the outer liner 204 and defines the second recirculation zone 202*b*. While one secondary combustion chamber 230 is shown and described in FIG. 2, the combustor 200 can include one or more secondary combustion chambers 230. For example, the secondary combustion chamber 230 can include discrete secondary combustion chambers 230 spaced circumferentially about the main combustion chamber 202. In some embodiments, the secondary combustion chamber 230 is a continuous combustion chamber that is annular about the main combustion chamber 202. The secondary combustion chamber 230 is a cavity and is utilized to produce the second recirculation zone 202*b* of a fuel-air mixture, as detailed further below. While FIG. 2 shows the secondary combustion chamber 230 formed in the outer liner 204, the secondary combustion chamber 230 can be formed in the inner liner 206. In some embodiments, both the outer liner 204 and the inner liner 206 include a secondary combustion chamber 230 formed therein. The secondary combustion chamber 230 is located axially aft of the annular dome 210. In this way, the secondary combustion chamber 230 is downstream of the annular dome 210. The secondary combustion chamber 230 is defined by a forward wall 232, an aft wall 234, and an axial wall 236 that extends axially from the forward wall 232 to the aft wall 234, and a secondary combustion chamber opening 238. The forward wall 232 and the aft wall 234 extend radially outward from the outer liner 204, and the axial wall 236 extends from the forward wall 232 to the aft wall 234, and the secondary combustion chamber 230 is defined between the forward wall 232, the aft wall 234, and the axial wall 236. In this way, the secondary combustion chamber 230 is located radially outward from the main combustion chamber 202. The secondary combustion chamber opening 238 is an opening in the outer liner 204 to provide flow communication from the secondary combustion chamber 230 to the main combustion chamber 202. While the secondary combustion chamber 230 illustrated in FIG. 2 includes a substantially rectangular cross section, the secondary combustion chamber 230 can include any shape.

The secondary combustion chamber 230 includes one or more secondary combustion chamber air holes 240 in the forward wall 232, in the aft wall 234, and/or in the axial wall 236. The one or more secondary combustion chamber air holes 240 operably direct the compressed air 65 through the forward wall 232, the aft wall 234, and/or the axial wall 236 into the secondary combustion chamber 230 to cool the forward wall 232, the aft wall 234, and/or the axial wall 236. A size of each of the one or more secondary combustion chamber air holes 240, the number of the one or more secondary combustion chamber air holes 240, and/or the circumferential spacing between respective ones of the one or more secondary combustion chamber air holes 240, may be based on a desired amount of cooling air (e.g., the compressed air 65) desired to cool the forward wall 232, the aft wall 234, and/or the axial wall 236. In addition, while FIG. 2 depicts the one or more secondary combustion chamber air holes 240 as being generally circular openings, other shapes may be implemented for the openings instead. For example, the one or more secondary combustion chamber air holes 240 may be oval-shaped slots, or the like. In some embodiments, the one or more secondary combustion chamber air holes 240 are sized to provide combustion air to the secondary combustion chamber 230 to aid in the combustion process within the secondary combustion chamber 230, as detailed further below.

The second fuel injector 224 is positioned to inject the fuel 67 into the secondary combustion chamber 230 such that the fuel 67 is mixed with the compressed air 65 that is swirled with the secondary combustion chamber air swirler 223 to generate a secondary combustion chamber swirl air flow 242. For example, the second fuel injector 224 is positioned on the aft wall 234. The secondary combustion chamber air swirler 223 is positioned on the forward wall 232. In this way, the fuel 67 from the second fuel injector 224 is injected into an aft stagnation region of the second recirculation zone 202*b* for flame stability, as detailed further below.

In operation, the combustor 200 receives compressed air 65 discharged from the HP compressor 24 (FIG. 1) in a diffuser section 250 at a location upstream of the main combustion chamber 202. A portion of the compressed air 65 is channeled through the first mixing assembly 212. At the first mixing assembly 212, the compressed air 65 is mixed with the fuel 67 from the first fuel injector 218 and discharged into the main combustion chamber 202. For example, the pilot mixer 214 mixes the compressed air 65 and the fuel 67 to generate a first mixture of compressed air 65 and fuel 67. The first mixture of compressed air 65 and fuel 67 is ignited by an igniter (not shown in FIG. 2 for clarity) creating a first flame within the main combustion chamber 202 that burns the first mixture and provides combustion gases 66 that are channeled downstream to a first stage turbine nozzle of the HP turbine 28 (FIG. 1). The first flame is also referred to as a pilot flame. A portion of the compressed air 65 is also channeled through the first main mixer 216 and the first main mixer 216 mixes the compressed air 65 and the fuel 67 to generate a second mixture of compressed air 65 and fuel 67. The second mixture of compressed air 65 and fuel 67 is ignited by the igniter creating a second flame within the main combustion chamber 202 that burns the second mixture and provides combustion gases 66 that are channeled downstream to the first stage turbine nozzle of the HP turbine 28. The second flame is referred to as a first main flame. The first flame and the second flame together are referred to as a nested flame. For example, a nested flame is when the pilot flame is at the center core of each fuel nozzle and the first main flame surrounds the pilot flame in the annular space about each fuel nozzle. In this way, the pilot flame is "nested" inside the first main flame. The nested flame (e.g., the first flame and the second flame) burns within the first combustion zone 202*a*.

A portion of the compressed air 65 is also injected through the one or more secondary combustion chamber air holes 240 into the secondary combustion chamber 230 to cool the forward wall 232, the aft wall 234, and/or the axial wall 236 (e.g., by film cooling). The secondary combustion chamber air swirler 223 injects the compressed air 65 into the secondary combustion chamber 230 and swirls the compressed air 65 to generate the secondary combustion chamber swirl air flow 242 within the second recirculation zone 202*b*. At the same time, the second fuel injector 224 injects the fuel 67 into the secondary combustion chamber 230. In the secondary combustion chamber 230, the compressed air 65 (e.g., the secondary combustion chamber swirl air flow 242) is mixed with the fuel 67 from the second fuel injector 224 to produce a third mixture of compressed air 65 and fuel 67. The third mixture of compressed air 65 and fuel 67 is ignited by an igniter (not shown in FIG. 2 for clarity) creating a third flame within the secondary combustion chamber 230 that burns the third mixture and generates combustion gases 66. The secondary combustion chamber 230 injects the combustion gases 66 through the secondary combustion chamber opening 238 into the main combustion chamber 202. The combustion gases 66 from the first recirculation zone 202*a* mix with the combustion gases 66 from the secondary combustion chamber 230 within the main combustion chamber 202 and then exit the main combustion chamber 202 through the combustion chamber outlet 211, and are channeled downstream to the first stage turbine nozzle of the HP turbine 28 (FIG. 1). The third flame is referred to as a second main flame or an auxiliary flame.

The combustor 200 is a multi-staged combustor. In particular, the plurality of first mixing assemblies 212 provides for radial fuel staging at the annular dome 210 in the first recirculation zone 202*a*, and the plurality of second mixing assemblies 220 provides for axial fuel staging in the second recirculation zone 202*b*. For example, the secondary combustion chamber 230, the plurality of second mixing assemblies 220 and the second recirculation zone 202*b* are located axially downstream of the plurality of first mixing assemblies 212 and the first recirculation zone 202*a*, respectively. Such a configuration of the combustor 200 provides for lean combustion provided by the plurality of first mixing assemblies 212 (e.g., by radially staging the pilot mixer 214 and the first main mixer 216), and even leaner combustion provided by the plurality of second mixing assemblies 220 to reduce $NO_x$ emissions as compared to combustors without the benefit of the present disclosure, as detailed further below.

The combustor 200 is a lean burn combustor. Specifically, at engine start conditions and at an engine low power operation (e.g., less than 30% of a sea level static (SLS) maximum engine rated thrust) of the turbine engine 10 (FIG. 1), such as at idle, at taxi, or at approach, the combustor 200 uses only fuel 67 provided to the pilot mixer 214 for generating the combustion gases 66. At the pilot mixer 214, fuel 67 includes a pilot fuel stream 260 that is mixed with a first portion 262 of the compressed air 65 to provide a rich fuel-air mixture (e.g., higher fuel to air ratios within the mixture) that is ignited for a pilot flame within the first recirculation zone 202*a* that is adjacent to the pilot mixer 214. The fuel-air mixture from the pilot mixer 214 is referred to as a pilot mixer fuel-air mixture.

In some embodiments, the combustor 200 can split the fuel 67 among the pilot mixer 214, the first main mixer 216, and/or the second main mixer 222 during the engine low power operation. For example, at the first main mixer 216, the fuel 67 includes a first main fuel stream 264 that is mixed with a second portion 266 of the compressed air 65 to provide a first lean fuel-air mixture (e.g., lower fuel to air ratios within the mixture) that is ignited for a first main flame within the first recirculation zone 202*a* of the main combustion chamber 202 that is adjacent to the first main mixer 216, thus, providing a lean burn combustion process to generate combustion gases 66 while reducing $NO_x$ emissions by operating fuel-lean, as detailed further below. Further, the lean burn combustion process provides for low non-volatile particulate matter (nvPM), such as soot or smoke, and reduces $NO_x$ emissions. The pilot mixer 214 injects the pilot fuel stream 260 generally axially from the first mixing assembly 212. The first main mixer 216 injects the first main fuel stream 264 radially outward from the first mixing assembly 212. In this way, the first mixing assembly 212 radially stages the fuel injection using the pilot mixer 214 (e.g., axial fuel injection) and the first main mixer 216 (e.g., radial fuel injection). The first main mixer 216 swirls the second portion 266 of the compressed air 65 in a first swirl direction to generate a main combustion chamber swirler air flow 269 in the main combustion chamber 202. The fuel-air mixture from the first main mixer 216 is referred to as a first main mixer fuel-air mixture.

At the second main mixer 222, the fuel 67 includes a second main fuel stream 270 that is mixed with secondary combustion chamber swirl air flow 242 to provide a second lean fuel-air mixture (e.g., lower fuel to air ratios within the mixture) that is ignited for a second main flame within the secondary combustion chamber 230 that is adjacent the second main mixer 222, thus, providing a lean burn combustion process to generate combustion gases 66 while further reducing $NO_x$ emissions by operating fuel-lean. The second main fuel-air mixture is more fuel-lean than the first main fuel-air mixture. The second main mixer 222 injects the second main fuel stream 270 axially forward into the secondary combustion chamber 230 that is axially downstream of the first main fuel-air mixture. The combustion gases 66 produced in the secondary combustion chamber 230 are then injected into the main combustion chamber 202 through the secondary combustion chamber opening 238 axially aft, or axially downstream, of the first recirculation zone 202*a*, as detailed above. In this way, the combustor 200 provides for both radial staging (e.g., at the first mixing assembly 212) and axial staging (e.g., at the second mixing assembly 220) to provide for a greater reduction in $NO_x$ emissions compared to combustors without the benefit of the present disclosure. For example, the air splits and the fuel splits to the plurality of first mixing assemblies 212 and to the plurality of second mixing assemblies 220 can be controlled at different operating conditions of the combustor 200 to reduce the $NO_x$ emissions throughout the entire operating cycle of the combustor 200, as detailed further below. The fuel-air mixture from the second main mixer 222 is referred to as a second main mixer fuel-air mixture.

At a high power operation (e.g., greater than 85% of SLS maximum engine rated thrust) of the turbine engine 10 (FIG. 1), such as at takeoff or at climb, and at a mid-level power operation (e.g., 30% to 85% of SLS maximum engine rated thrust) of the turbine engine 10 (FIG. 1), such as at cruise, the combustor 200 splits the fuel 67 among the pilot mixer 214, the first main mixer 216, and the second main mixer 222 for generating the combustion gases 66 in the first recirculation zone 202*a* of the main combustion chamber 202 and in the second recirculation zone 202*b* of the secondary combustion chamber 230. In this way, the combustor 200 permits control of the combustion dynamics in a radially-staged and axially-staged combustion configuration. The fuel split among the pilot mixer 214, the first main mixer 216, and the second main mixer 222 can be optimized to mitigate dynamics while also meeting combustor performance metrics for the various operating cycles of the turbine engine 10 (FIG. 1). For example, the fuel split among the pilot mixer 214, the first main mixer 216, and the second main mixer 222 is controlled to reduce $NO_x$ emissions during the entire operating cycle (e.g., idle, taxi, takeoff, climb, cruise, and approach). Staging in such a way (e.g., radially-staged and axially-staged) allows for higher mixer air flows so that the combustor 200 operates fuel-lean for operability in both a forward portion and an aft portion of the combustor 200 at high power conditions while reducing $NO_x$ emissions as compared to combustors without the benefit of the present disclosure that utilize axial staging only and operate fuel-rich at high power conditions.

During operation, the compressed air 65 is split among the annular dome 210, the pilot mixer 214, the first main mixer 216, the second main mixer 222 (e.g., the secondary combustion chamber 230), between the outer liner 204 and the annular combustor casing 208, and between the inner liner 206 and the annular combustor casing 208. The compressed air 65 is split to provide a lean combustor in both the first recirculation zone 202*a* and the secondary combustion chamber 230, as detailed further below. For example, the combustor 200, the annular dome 210, the plurality of first mixing assemblies 212, and the plurality of second mixing assemblies 220 are oriented and configured to provide 5% to 9% of the compressed air 65 to the annular dome 210, 7% to 20% of the compressed air 65 to the pilot mixer 214 (e.g., the first portion 262 of compressed air 65), 30% to 60% of the compressed air 65 to the first main mixer 216 (e.g., the second portion 266 of compressed air 65), 11% to 30% of the compressed air 65 to the second main mixer 222 (e.g., the secondary combustion chamber swirl air flow 242), 7% to 10% of the compressed air 65 to the outer liner 204 and the inner liner 206 in an area forward of the plurality of second mixing assemblies 220, and 6% to 9% of the compressed air 65 to the outer liner 204 and the inner liner 206 in an area aft of the plurality of second mixing assemblies 220.

The annular dome 210 can include one or more cooling holes to provide the compressed air 65 through the annular dome 210 into the main combustion chamber 202 to cool a downstream side of the annular dome 210 (e.g., a side of the annular dome 210 that is exposed to the main combustion chamber 202). The outer liner 204 can include one or more cooling holes located on the outer liner 204 forward and aft of the plurality of second mixing assemblies 220 to provide the compressed air 65 through the outer liner 204 into the main combustion chamber 202 to cool an inner surface of the outer liner 204 (e.g., a surface of the outer liner 204 that is exposed to the main combustion chamber 202). Similarly, the inner liner 206 can include one or more cooling holes located on the inner liner 206 forward and aft of the plurality of second mixing assemblies 220 to provide the compressed air 65 through the inner liner 206 into the main combustion chamber 202 to cool an inner surface of the inner liner 206 (e.g., a surface of the inner liner 206 that is exposed to the main combustion chamber 202).

The fuel 67 is split among the pilot mixer 214, the first main mixer 216, and the second main mixer 222 to provide lean combustion in the first recirculation zone 202*a* and the secondary combustion chamber 230 to reduce $NO_x$ emissions. For example, the pilot fuel stream 260 includes 90% to 100% of the fuel 67 during idle conditions of the turbine engine, 35% to 50% of the fuel during approach conditions of the turbine engine, 20% to 40% of the fuel during cruise conditions of the turbine engine, and 5% to 20% of the fuel during climb conditions or take-off conditions of the turbine engine. The first main fuel stream 264 includes 0% to 5% of the fuel during idle conditions of the turbine engine, 50% to 58% of the fuel during approach conditions of the turbine engine, 55% to 70% of the fuel during cruise conditions of the turbine engine, and 65% to 72% of the fuel during climb conditions or take-off conditions of the turbine engine. The second main fuel stream includes 0% to 5% of the fuel during idle conditions of the turbine engine, 0% to 7% of the fuel during approach conditions of the turbine engine, 5% to 10% of the fuel during cruise conditions of the turbine engine, and 15% to 23% of the fuel during climb conditions or take-off conditions of the turbine engine. The fuel splits are selected to be fuel-rich for good operability at low power operation (e.g., idle, taxi, approach, etc.) and to be fuel-lean at mid-power operation (e.g., cruise) and high power operation (e.g., take-off or climb) for low $NO_x$ emissions.

The fuel-air mixture for each of the pilot mixer 214, the first main mixer 216, and the second main mixer 222 is defined by an equivalence ratio. The equivalence ratio is an actual fuel-air ratio (e.g., the fuel-air splits detailed above) to a stoichiometric fuel-air ratio. The actual fuel-air ratio is the fuel-air ratio provided to each of the pilot mixer 214, the first main mixer 216, and the second main mixer 222. The stoichiometric fuel-air ratio is an ideal fuel-air ratio that burns all fuel with no excess air. If the equivalence ratio is less than one, the combustion is considered lean with excess air, and if the equivalence ratio is greater than one, the combustion is considered rich with incomplete combustion.

In general, for the pilot mixer 214, the pilot mixer equivalence ratio decreases from idle, to approach, to cruise, to climb, and to take-off. For example, the pilot mixer 214 operates fuel-rich (e.g., the pilot mixer equivalence ratio is greater than one) for the operating cycle of the turbine engine 10 (FIG. 1) and, in some embodiments, can operate fuel-lean (e.g., the pilot mixer equivalence ratio is less than one) during high power operation. In general, for the first main mixer 216, the first main mixer equivalence ratio increases from idle, to approach, to cruise, to climb, to take-off. For example, the first main mixer 216 operates fuel-lean (e.g., the first main mixer equivalence ratio is greater than one) for the entire operating cycle of the turbine engine 10 (FIG. 1). In general, for the second main mixer 222, the second main mixer equivalence ratio increases from idle, to approach, to cruise, to climb, and to take-off. For example, the second main mixer 222 operates fuel-lean (e.g., the second main mixer equivalence ratio is greater than one) for the entire operating cycle of the turbine engine 10 (FIG. 1). The second main mixer 222 operates more fuel-lean than the first main mixer 216 (e.g., the second main mixer equivalence ratio is less than the first main mixer equivalence ratio). In this way, the pilot mixer 214 is fuel-rich at low power operation for operability of the combustor 200, and the first main mixer 216 and the second main mixer 222 are fuel-lean during high power operation for low $NO_x$ emissions. Further, since the second main mixer 222 is position downstream within the combustor 200, the combustion process generated by the second main mixer 222 has a short residence time compared to the residence time of the first main mixer 216 (e.g., located at a forward end of the combustor 200). In this way, the second main mixer 222 operates fuel-lean so as to not inject a rich streak of fuel downstream within the combustion chamber 202.

In some embodiments, the compressed air 65 and the fuel 67 are split between the pilot mixer 214 and the second main mixer 222 to provide rich burn combustion (e.g., equivalence ratios greater than one) in the main combustion chamber 202 and lean burn combustion in the secondary combustion chamber 230 to reduce $NO_x$ emissions. For example, the compressed air 65 splits are selected to provide a rich burn combustor in the main combustion chamber 202 and a lean burn combustor in the secondary combustion chamber 230 (e.g., from which the combustion gases 66 are injected into the second recirculation zone 202*b*), as detailed further below.

Figure 3:
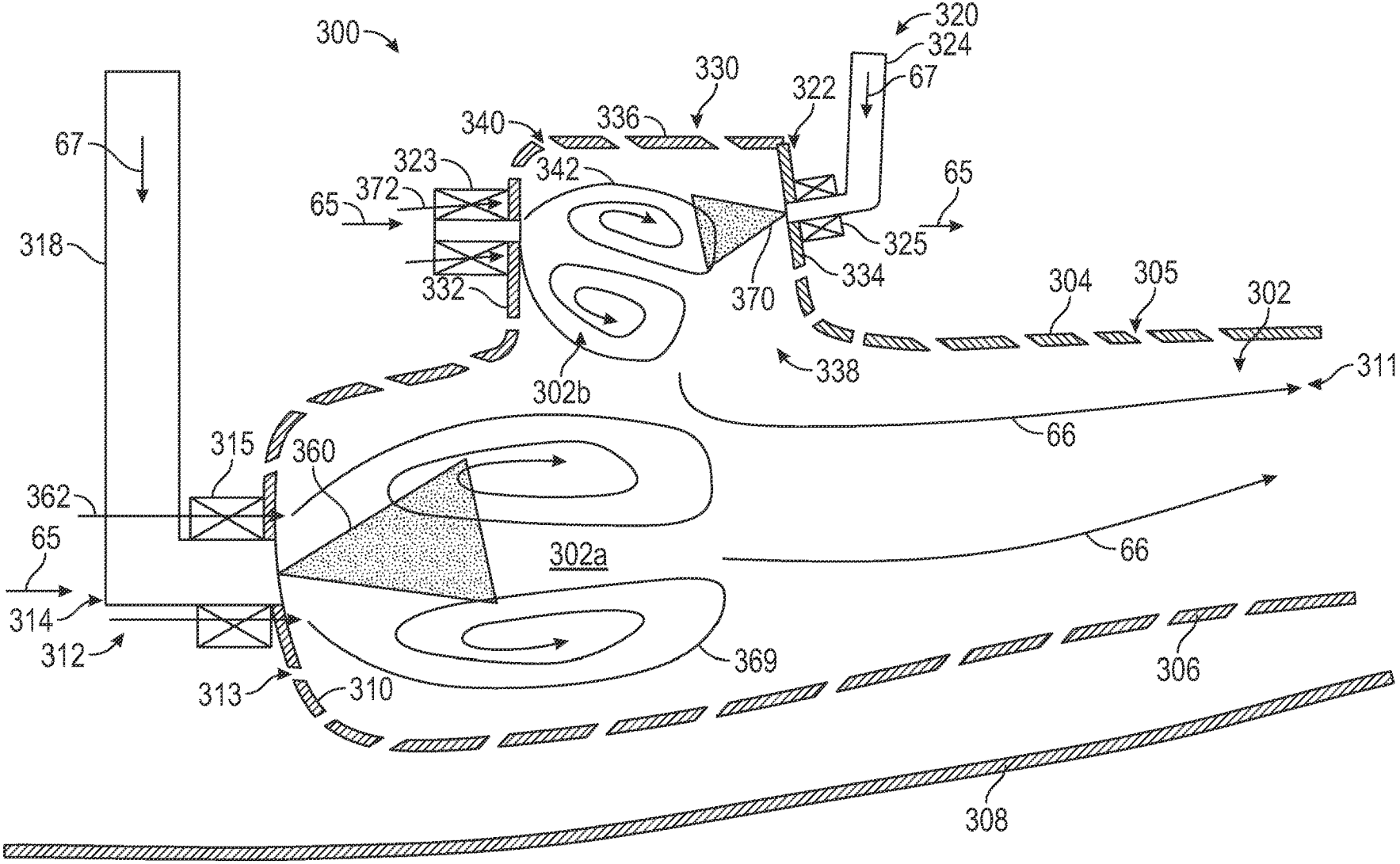
FIG. 3 is a schematic cross-sectional diagram of a combustor for a turbine engine, taken along a longitudinal centerline axis of the turbine engine, according to another embodiment.

FIG. 3 is a schematic cross-sectional diagram of a combustor 300 for a turbine engine, taken along a longitudinal centerline axis of the turbine engine, according to another embodiment. The combustor 300 is substantially similar to the combustor 200 of FIG. 2. The combustor 300, however, is a rich dome combustor, as detailed further below. The combustor 300 includes a main combustion chamber 302, an outer liner 304, an inner liner 306, and annular combustor casing 308, an annular dome 310, a combustion chamber outlet 311, a plurality of first mixing assemblies 312 including a pilot mixer 314 and a first fuel injector 318, a plurality of second mixing assemblies 320 including a main mixer 322 and a second fuel injector 324, and a secondary combustion chamber 330. The annular dome 310 includes one or more annular dome air holes 313 that operably direct the compressed air 65 through the annular dome 310 for cooling a downstream surface of the annular dome 310 within the main combustion chamber 302 (e.g., by film cooling). The plurality of first mixing assemblies 312 injects a pilot mixer fuel-air mixture into a first recirculation zone 302*a* within the main combustion chamber 302, and the plurality of second mixing assemblies 320 injects a main mixer fuel-air mixture into a second recirculation zone 302*b* within the secondary combustion chamber 330. The secondary combustion chamber 330 is defined by a forward wall 332, an aft wall 334, and an axial wall 336, and includes a secondary combustion chamber opening 238. The secondary combustion chamber 330 includes one or more secondary combustion chamber air holes 340 disposed in the forward wall 332, the aft wall 334, and/or the axial wall 336.

The main combustion chamber 302 includes a main combustion chamber volume $V_1$ defined as the volume of the main combustion chamber 302 within the outer liner 304 and the inner liner 306. The secondary combustion chamber 330 includes a secondary combustion chamber volume $V_2$ defined as the volume of the secondary combustion chamber 330 within the forward wall 332, the aft wall 334, and the axial wall 336. The secondary combustion chamber volume $V_2$ is less than the main combustion chamber volume $V_1$. For example, the secondary combustion chamber $V_2$ is 10% to 80% of the main combustion chamber volume $V_1$.

The plurality of second mixing assemblies 320 includes one or more secondary combustion chamber air swirlers 323, 325 disposed through forward wall 332 and the aft wall 334 of the secondary combustion chamber 330. For example, one or more secondary combustion chamber air swirlers 323, 325 include a first secondary combustion chamber air swirler 323 through the forward wall 332 for introducing the compressed air 65 into the secondary combustion chamber 330 and to generate a secondary combustion chamber swirl air flow 342. The one or more secondary combustion chamber air swirlers 323, 325 also include a second secondary combustion chamber air swirler 325 disposed through the aft wall 334 for introducing the compressed air 65 into the secondary combustion chamber 330 and to help generate the secondary combustion chamber swirl air flow 342. In FIG. 3, the second secondary combustion chamber air swirler 325 is associated with the main mixer 322, and the first secondary combustion chamber air swirler 323 is a standalone air swirler. The outer liner 304 and/or the inner liner 306 include one or more liner air holes 305 that operably direct the compressed air 65 through the outer liner 304 and/or through the inner liner 306 and into the main combustion chamber 302 to cool the outer liner 304 and/or the inner liner 306 (e.g., by film cooling).

Similar to the combustor 200 of FIG. 2, the second fuel injector 224 is positioned to inject the fuel 67 into the secondary combustion chamber 230 such that the fuel 67 is mixed with the compressed air 65 that is swirled with the secondary combustion chamber air swirler 223 to generate a secondary combustion chamber swirl air flow 242. For example, the second fuel injector 224 is positioned on the aft wall 234. The secondary combustion chamber air swirler 223 is positioned on the forward wall 232. In this way, the fuel 67 from the second fuel injector 224 is injected into an aft stagnation region of the second recirculation zone 202*b* for flame stability.

The plurality of first mixing assemblies 312, however, does not include a main mixer associated therewith. In this way, the plurality of first mixing assemblies 312 includes only the pilot mixer 314 and the first fuel injector 318. Each of the plurality of first mixing assemblies 312 also includes a main combustion chamber air swirler 315 that swirls the compressed air 65 through the pilot mixer 314 and into the main combustion chamber 302, as detailed further below.

The combustor 300 operates substantially similarly as the combustor 200 of FIG. 2, as detailed above. The combustor 300 is a multi-staged combustor. In particular, the plurality of first mixing assemblies 312 provides for fuel staging at the annular dome 310 in the first recirculation zone 302*a*, and the plurality of second mixing assemblies 320 provides for axial fuel staging in the second recirculation zone 302*b*. For example, the secondary combustion chamber 330, the plurality of second mixing assemblies 320, and the second recirculation zone 302*b* are located axially downstream of the plurality of first mixing assemblies 312 and the first recirculation zone 302*a*, respectively. Such a configuration of the combustor 300 provides for rich combustion in the first recirculation zone 302*a* (e.g., in an area of the annular dome 310) provided by the plurality of first mixing assemblies 312 (e.g., by the pilot mixer 314), and lean combustion provided by the plurality of second mixing assemblies 320 to further reduce $NO_x$ emissions as compared to combustors without the benefit of the present disclosure, as detailed further below.

The combustor 300 is a rich dome combustor defined by rich combustion in the first recirculation zone 302*a* in an area of the annular dome 310 within the main combustion chamber 302. Specifically, at engine start conditions and at engine low power operation (e.g., less than 30% of a sea level static (SLS) maximum engine rated thrust) of the turbine engine 10 (FIG. 1), such as at idle, at taxi, or at approach, the combustor 300 uses only fuel 67 provided to the pilot mixer 314 for generating the combustion gases 66. At the pilot mixer 314, fuel 67 includes a pilot fuel stream 360 that is mixed with a first portion 362 of the compressed air 65 to provide a rich fuel-air mixture (e.g., higher fuel to air ratios within the mixture) that is ignited for a pilot flame within the first recirculation zone 302*a* that is adjacent to the pilot mixer 314 and within an area of the annular dome 310. The fuel-air mixture from the pilot mixer 314 is referred to as a pilot mixer fuel-air mixture. The pilot mixer 214 injects the pilot fuel stream 260 generally axially from the first mixing assembly 212. The pilot mixer 314 (e.g., the main combustion chamber air swirler 315) swirls the first portion 362 of the compressed air 65 in a first swirl direction to generate a main combustion chamber swirler air flow 369 in the main combustion chamber 302.

In some embodiments, the combustor 300 can split the fuel 67 between the pilot mixer 314 and the main mixer 322 during the engine low power operation. For example, at the secondary combustion chamber 330, the fuel 67 includes a main fuel stream 370 (e.g., injected from the second fuel injector 324) that is mixed with a second portion 372 of the compressed air 65 (e.g., injected through first secondary combustion chamber air swirler 323) to provide a lean fuel-air mixture (e.g., lower fuel to air ratios within the mixture) that is ignited for a main flame within the secondary combustion chamber 330 that is adjacent the main mixer 322, thus, providing a lean burn combustion process to generate combustion gases 66 while further reducing $NO_x$ emissions by operating fuel-lean. Further, the lean burn combustion process provides for low non-volatile particulate matter (nvPM), such as soot or smoke, and reduces $NO_x$ emissions. The fuel-air mixture from the main mixer 322 is referred to as a second main mixer fuel-air mixture.

The main mixer 322 injects the main fuel stream 370 axially forward into the secondary combustion chamber 330 that is axially downstream of the pilot mixer fuel-air mixture. The combustion gases 66 produced in the secondary combustion chamber 330 are then injected into the main combustion chamber 302 through the secondary combustion chamber opening 338 axially aft, or axially downstream, of the first recirculation zone 302*a*, as detailed above. In this way, the combustor 300 provides for axial staging (e.g., at the second mixing assembly 320) within the secondary combustion chamber 330 to provide for a greater reduction in $NO_x$ emissions compared to combustors without the benefit of the present disclosure. For example, the air splits and the fuel splits to the plurality of first mixing assemblies 312 and to the plurality of second mixing assemblies 320 can be controlled at different operating conditions of the combustor 300 to reduce the $NO_x$ emissions throughout the entire operating cycle of the combustor 300, as detailed further below.

At a high power operation (e.g., greater than 85% of SLS maximum engine rated thrust) of the turbine engine 10 (FIG. 1), such as at takeoff or at climb, and at mid-level power operation (e.g., 30% to 85% of SLS maximum engine rated thrust) of the turbine engine 10 (FIG. 1), such as at cruise, the combustor 300 splits the fuel 67 between the pilot mixer 314 and the main mixer 322 for generating the combustion gases 66 in the first recirculation zone 302*a* of the main combustion chamber 302 and in the second recirculation zone 302*b* of the secondary combustion chamber 330. In this way, the combustor 300 permits control of the combustion dynamics in an axially staged combustion configuration in which the axially staging is provided by the secondary combustion chamber 330 located axially aft, or downstream, of the first recirculation zone 302*a*. The fuel split between the pilot mixer 314 and the main mixer 322 can be optimized to mitigate dynamics while also meeting combustor performance metrics for the various operating cycles of the turbine engine 10 (FIG. 1). For example, the fuel split between the pilot mixer 314 and the main mixer 322 is controlled to reduce $NO_x$ emissions during the entire operating cycle (e.g., idle, taxi, takeoff, climb, cruise, and approach). Such a configuration of the combustor 300 (e.g., a rich dome combustor with an axial staged secondary combustion chamber that operates fuel-lean) provides for even leaner combustion at high fuel-air ratios for advanced engine thermodynamic cycles, thereby reducing $NO_x$ emissions, as compared to combustors without the benefit of the present disclosure.

During operation, the compressed air 65 is split among the annular dome 310, the pilot mixer 314, the main mixer 322 (e.g., the secondary combustion chamber 330), between the outer liner 304 and the annular combustor casing 308, and between the inner liner 306 and the annular combustor casing 308. The compressed air 65 is split to provide a rich burn in the first recirculation zone 302*a* and a lean burn in the secondary combustion chamber 330, as detailed further below. For example, the combustor 300, the annular dome 310, the plurality of first mixing assemblies 312, and the plurality of second mixing assemblies 320 are oriented and configured to provide 5% to 9% of the compressed air 65 to the annular dome 310, 12% to 20% of the compressed air 65 to the pilot mixer 314 (e.g., the first portion 362 of compressed air 65), 15% to 30% of the compressed air 65 to the main mixer 322 (e.g., the second portion 372 of compressed air 65), 35% to 50% of the compressed air 65 to dilution holes (e.g., the secondary combustion chamber air holes 340), 7% to 10% of the compressed air 65 as cooling air to the outer liner 304 and the inner liner 306 in an area forward of the plurality of second mixing assemblies 320, and 6% to 9% of the compressed air 65 as cooling air to the outer liner 304 and the inner liner 306 in an area aft of the plurality of second mixing assemblies 320.

In a first rich dome embodiment, the pilot fuel stream 360 includes 95% to 100% of the fuel 67 during idle conditions of the turbine engine, 95% to 100% of the fuel during approach conditions of the turbine engine, 95% to 100% of the fuel during cruise conditions of the turbine engine, and 65% to 80% of the fuel during climb conditions or take-off conditions of the turbine engine. The main fuel stream 370 includes 0% to 5% of the fuel during idle conditions of the turbine engine, 0% to 5% of the fuel during approach conditions of the turbine engine, 0% to 5% of the fuel during cruise conditions of the turbine engine, and 20% to 35% of the fuel during climb conditions or take-off conditions of the turbine engine.

In general, for the pilot mixer 314, the pilot mixer equivalence ratio increases from idle, to approach, to cruise, to climb, and to take-off. For example, the pilot mixer 314 generates a rich burn (e.g., the pilot mixer equivalence ratio is greater than one) for the operating cycle of the turbine engine (e.g., the turbine engine 10 of FIG. 1). In general, for the main mixer 322, the main mixer equivalence ratio increases from idle, to approach, to cruise, to climb, and to take-off. For example, the main mixer 322 generates a lean burn (e.g., the main mixer equivalence ratio is less than one) for the entire operating cycle of the turbine engine (e.g., the turbine engine 10 of FIG. 1).

In a second rich dome embodiment, the compressed air 65 and the fuel 67 are split between the pilot mixer 314 and the main mixer 322 to provide a combination of rich burn combustion in the first recirculation zone 302*a* of the main combustion chamber 302 and lean burn combustion in the second recirculation zone 302*b* of the secondary combustion chamber 330 to reduce $NO_x$ emissions. For example, in the second rich dome embodiment, the annular dome 310, the plurality of first mixing assemblies 312 and the plurality of second mixing assemblies 320 are oriented and configured to provide 5% to 9% of the compressed air 65 to the annular dome 310, 12% to 20% of the compressed air 65 to the pilot mixer 314 (e.g., the first portion 262 of compressed air 65), 45% to 65% of the compressed air 65 to the main mixer 322 (e.g., the second portion 372 of compressed air 65), 5% to 15% of the compressed air 65 to the dilution holes, 7% to 9% of the compressed air 65 to the outer liner 304 and the inner liner 306 in an area forward of the plurality of second mixing assemblies 320, and 7% to 9% of the compressed air 65 to the outer liner 304 and the inner liner 306 in an area aft of the plurality of second mixing assemblies 320.

In the second rich burn embodiment, the pilot fuel stream 360 includes 80% to 100% of the fuel 67 during idle conditions of the turbine engine, 40% to 100% of the fuel during approach conditions of the turbine engine, 15% to 50% of the fuel during cruise conditions of the turbine engine, and 15% to 50% of the fuel during climb conditions or take-off conditions of the turbine engine. The main fuel stream 370 includes 0% to 20% of the fuel during idle conditions of the turbine engine, 0% to 60% of the fuel during approach conditions of the turbine engine, 50% to 85% of the fuel during cruise conditions of the turbine engine, and 50% to 85% of the fuel during climb conditions or take-off conditions of the turbine engine.

In general, for the pilot mixer 314, the pilot mixer equivalence ratio decreases from idle, to approach, to cruise, and increases from cruise to climb, and to take-off. For example, the pilot mixer 314 generates a rich burn (e.g., the pilot mixer equivalence ratio is greater than one) for the operating cycle of the turbine engine (e.g., the turbine engine 10 of FIG. 1). In some instances, the pilot mixer 314 can operate fuel-lean (e.g., the pilot mixer equivalence ratio is less than one), for example, during mid-power operation (e.g., cruise) or high-power operation (e.g., take-off or climb). In general, for the main mixer 322, the main mixer equivalence ratio increases from idle, to approach, to cruise, to climb, and to take-off. For example, the main mixer 322 generates a lean burn (e.g., the main mixer equivalence ratio is less than one) for the entire operating cycle of the turbine engine (e.g., the turbine engine 10 of FIG. 1).

Figure 4:
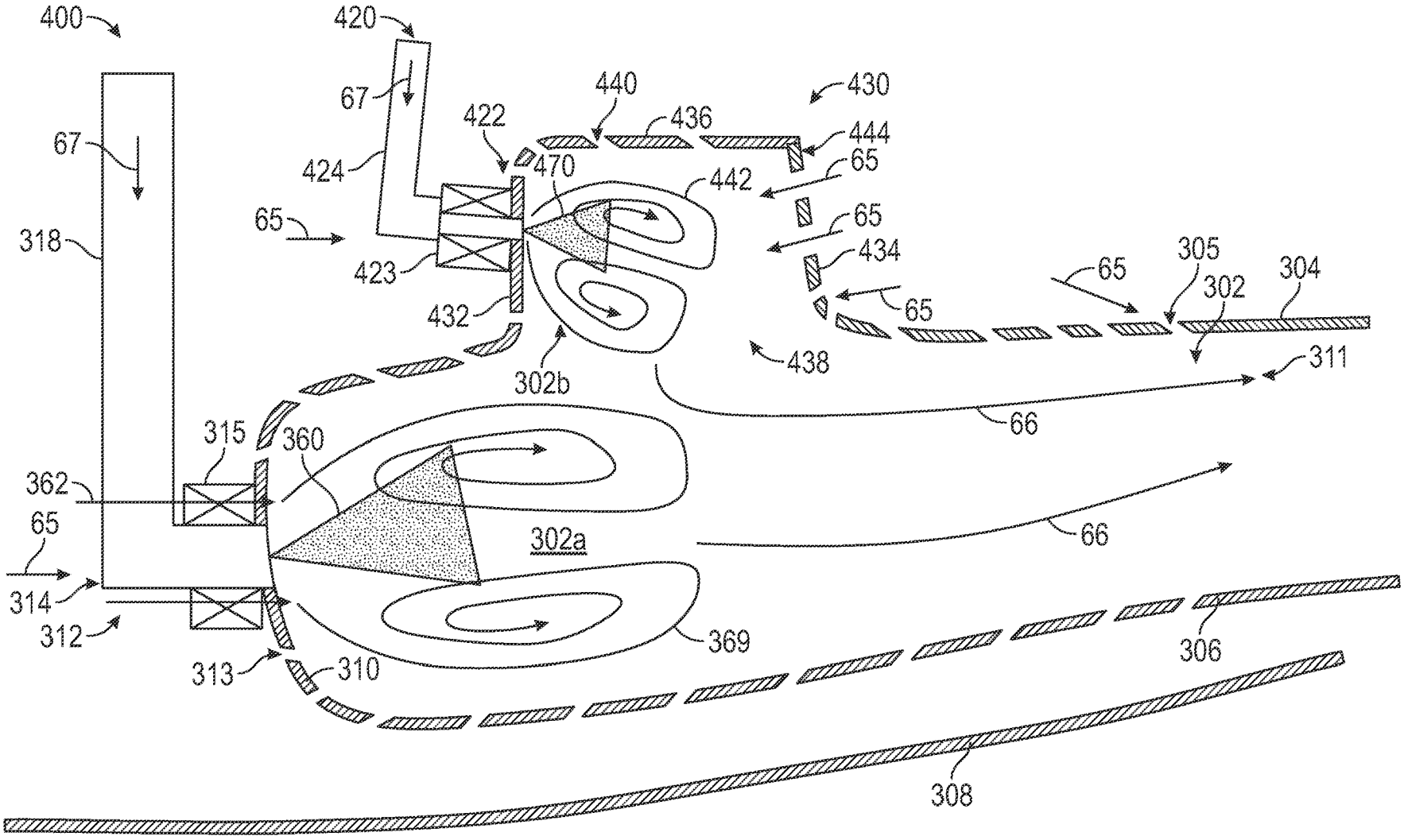
FIG. 4 is a schematic cross-sectional diagram of a combustor for a turbine engine, taken along a longitudinal centerline axis of the turbine engine, according to another embodiment.

FIG. 4 is a schematic cross-sectional diagram of a combustor 400 for a turbine engine, taken along a longitudinal centerline axis of the turbine engine, according to another embodiment. The combustor 400 is substantially similar to the combustor 300 of FIG. 3 and is a rich dome combustor. The combustor 400 includes a secondary combustion chamber 430, however, that is different from the secondary combustion chamber 330 of FIG. 3.

The secondary combustion chamber 430 is defined by a forward wall 432, an aft wall 434, an axial wall 436, and a secondary combustion chamber opening 438. The secondary combustion chamber 430 includes one or more secondary combustion chamber air holes 440 in the forward wall 432 and/or the axial wall 436. The combustor 400 includes the plurality of first mixing assemblies 312 including the pilot mixer 314 and the first fuel injector 318, and a plurality of second mixing assemblies 420 including a main mixer 422 and a second fuel injector 424. The main mixer 422 includes a secondary combustion chamber air swirler 423 for swirling the compressed air 65 to generate a secondary combustion chamber swirl air flow 442 within the second recirculation zone 302*b*, as detailed above. The secondary combustion chamber air swirler 423 is disposed through the forward wall 432. The plurality of second mixing assemblies 420 are positioned through the forward wall 432. In this way, the main mixer 422 is located on the same side of the secondary combustion chamber 430 as the secondary combustion chamber air swirler 423 and the main mixer 422 injects a main fuel stream 470 of the fuel 67 axially aftward within the second recirculation zone 302*b* of the secondary combustion chamber 430.

The secondary combustion chamber 430 also includes one or more combustion air holes 444 disposed through the aft wall 434. The one or more combustion air holes 444 are sized to operably direct the compressed air 65 into the secondary combustion chamber 430 for providing additional air in the combustion process within the secondary combustion chamber 430. In this way, the one or more combustion air holes 444 are larger than the one or more secondary combustion chamber air holes 440. The one or more combustion air holes 444 operably direct the compressed air 65 axially forward through the aft wall 434 and into the secondary combustion chamber 430.

Figure 5:
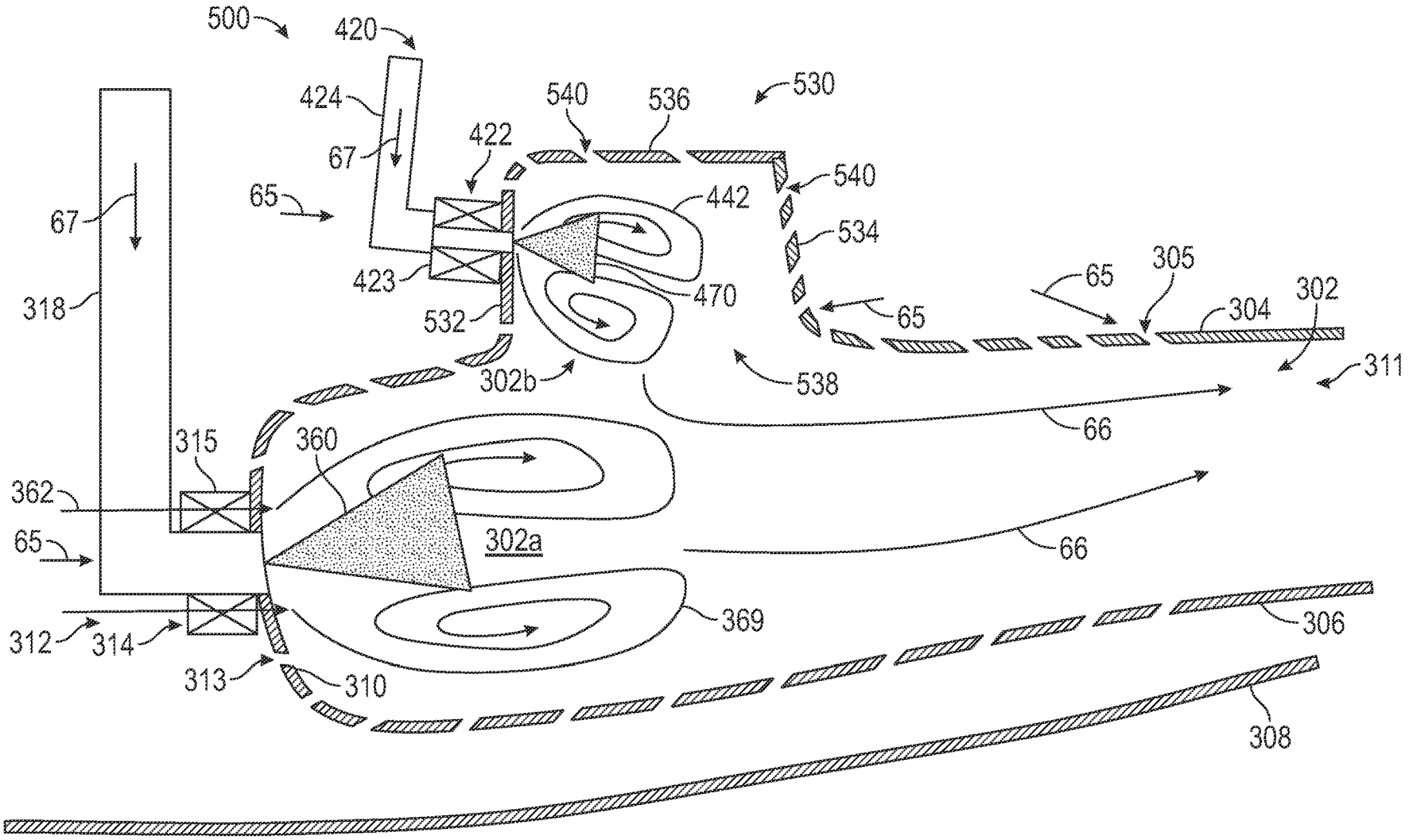
FIG. 5 is a schematic cross-sectional diagram of a combustor for a turbine engine, taken along a longitudinal centerline axis of the turbine engine, according to another embodiment.

FIG. 5 is a schematic cross-sectional diagram of a combustor 500 for a turbine engine, taken along a longitudinal centerline axis of the turbine engine, according to another embodiment. The combustor 500 is substantially similar to the combustor 400 of FIG. 4 and is a rich dome combustor. The combustor 500 includes a secondary combustion chamber 530, however, that is different from the secondary combustion chamber 430 of FIG. 4.

The secondary combustion chamber 530 is defined by a forward wall 532, an aft wall 534, an axial wall 536, and a secondary combustion chamber opening 538. The secondary combustion chamber 530 also includes one or more secondary combustion chamber air holes 540 in the forward wall 532, the aft wall 534, and/or the axial wall 536. In this way, the secondary combustion chamber 530 does not include one or more combustion air holes.

Figure 6:
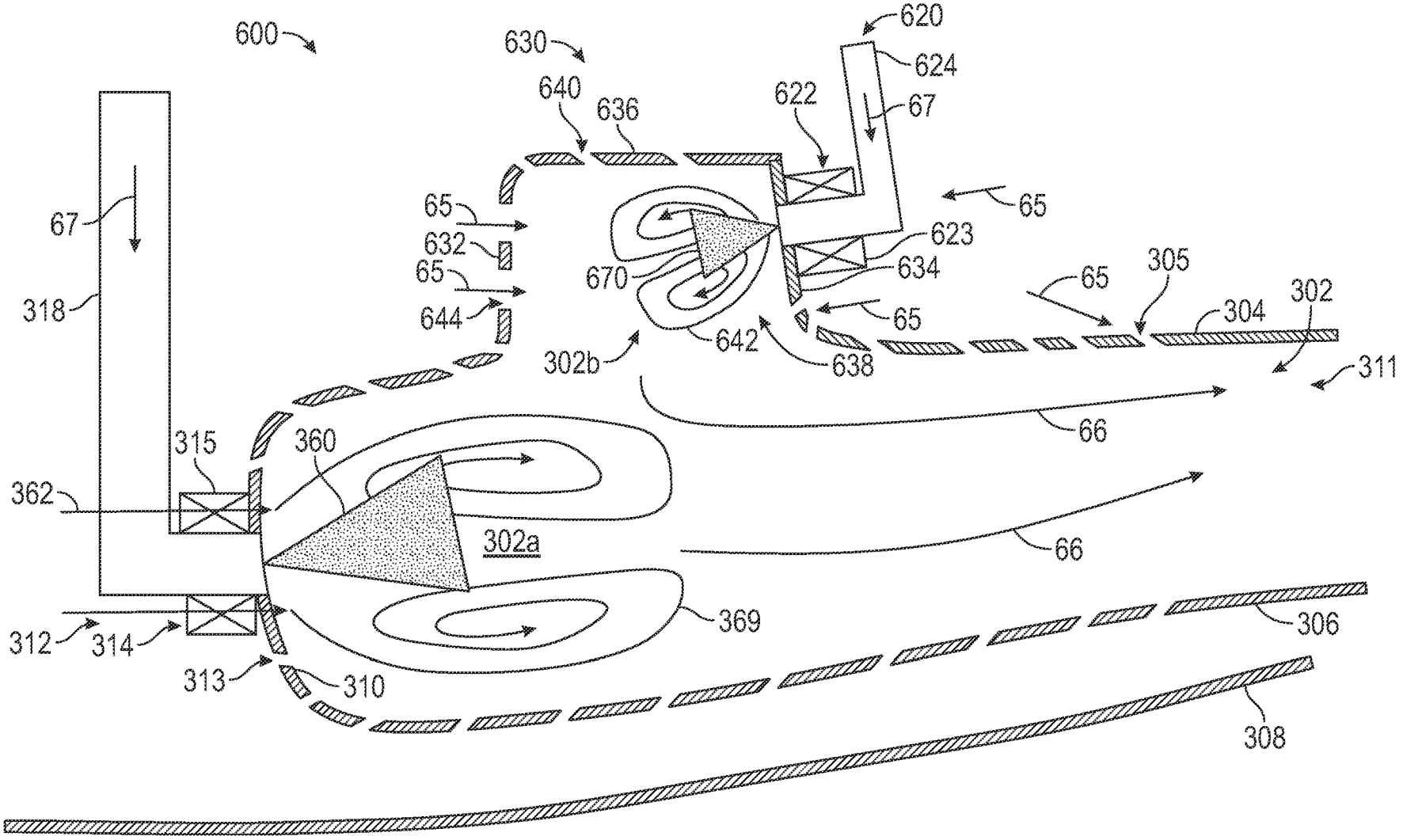
FIG. 6 is a schematic cross-sectional diagram of a combustor for a turbine engine, taken along a longitudinal centerline axis of the turbine engine, according to another embodiment.

FIG. 6 is a schematic cross-sectional diagram of a combustor 600 for a turbine engine, taken along a longitudinal centerline axis of the turbine engine, according to another embodiment. The combustor 600 is substantially similar to the combustors 300, 400 of FIGS. 3 and 4, respectively, and is a rich dome combustor. The combustor 600 includes a secondary combustion chamber 630, however, that is different from the secondary combustion chambers 330, 430 of FIGS. 3 and 4, respectively.

The secondary combustion chamber 630 is defined by a forward wall 632, an aft wall 634, an axial wall 636, and a secondary combustion chamber opening 638. The secondary combustion chamber 630 also includes one or more secondary combustion chamber air holes 640 in the aft wall 634 and/or the axial wall 636. The combustor 600 includes the plurality of first mixing assemblies 312 including the pilot mixer 314 and the first fuel injector 318, and a plurality of second mixing assemblies 620 including a main mixer 622 and a second fuel injector 624. The main mixer 622 includes a secondary combustion chamber air swirler 623 for swirling the compressed air 65 to generate a secondary combustion chamber swirl air flow 642 within the second recirculation zone 302*b*, as detailed above. The secondary combustion chamber air swirler 623 is positioned through the aft wall 634. The plurality of second mixing assemblies 620 are positioned through the aft wall 634. In this way, the main mixer 622 is located on the same side of the secondary combustion chamber 630 as the secondary combustion chamber air swirler 623 and the main mixer 622 injects a main fuel stream 670 of the fuel 67 axially forward within the second recirculation zone 302*b* of the secondary combustion chamber 630.

The secondary combustion chamber 630 also includes one or more combustion air holes 644 disposed through the forward wall 632. The one or more combustion air holes 644 are sized to operably direct the compressed air 65 into the secondary combustion chamber 630 for providing additional air in the combustion process within the secondary combustion chamber 630. In this way, the one or more combustion air holes 644 are larger than the one or more secondary combustion chamber air holes 640. The one or more combustion air holes 644 operably direct the compressed air 65 axially aftward through the forward wall 632 and into the secondary combustion chamber 630.

Figure 7:
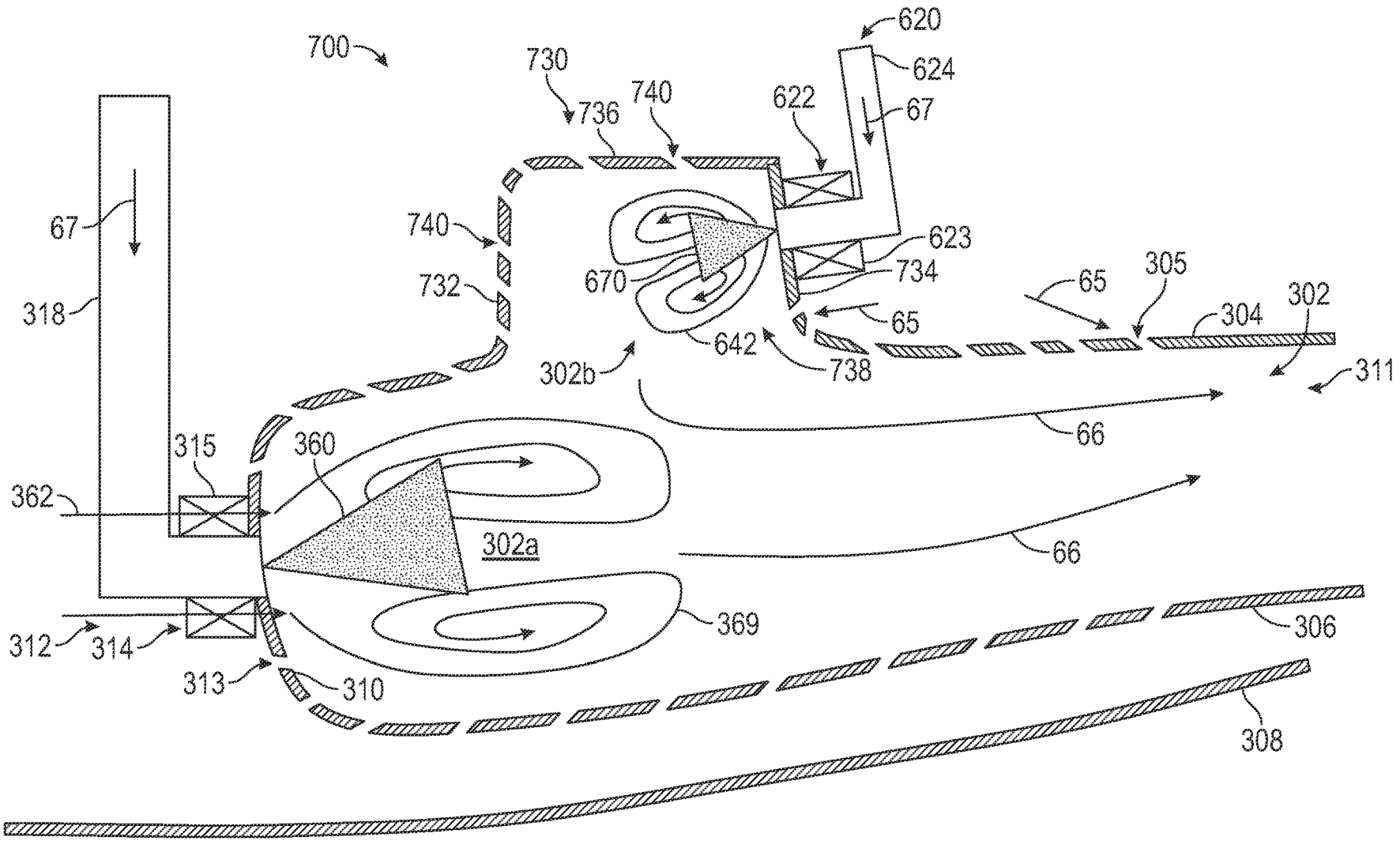
FIG. 7 is a schematic cross-sectional diagram of a combustor for a turbine engine, taken along a longitudinal centerline axis of the turbine engine, according to another embodiment.

FIG. 7 is a schematic cross-sectional diagram of a combustor 700 for a turbine engine, taken along a longitudinal centerline axis of the turbine engine, according to another embodiment. The combustor 700 is substantially similar to the combustor 600 of FIG. 6 and is a rich dome combustor. The combustor 700 includes a secondary combustion chamber 730, however, that is different from the secondary combustion chamber 630 of FIG. 6.

The secondary combustion chamber 730 is defined by a forward wall 732, an aft wall 734, an axial wall 736, and a secondary combustion chamber opening 738. The secondary combustion chamber 730 also includes one or more secondary combustion chamber air holes 740 in the forward wall 732, the aft wall 734, and/or the axial wall 736. In this way, the secondary combustion chamber 730 does not include one or more combustion air holes.

Figure 8:
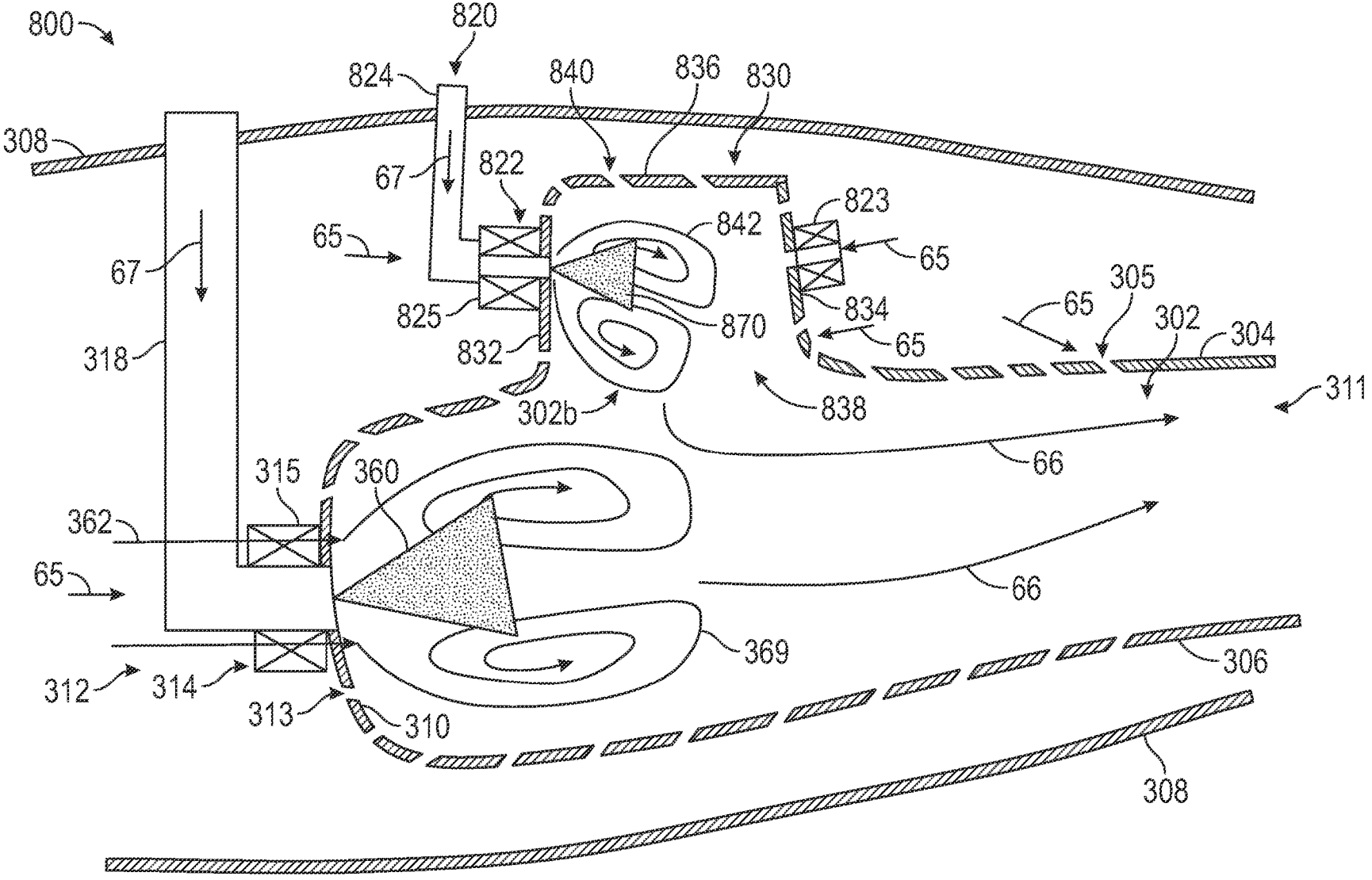
FIG. 8 is a schematic cross-sectional diagram of a combustor for a turbine engine, taken along a longitudinal centerline axis of the turbine engine, according to another embodiment.

FIG. 8 is a schematic cross-sectional diagram of a combustor 800 for a turbine engine, taken along a longitudinal centerline axis of the turbine engine, according to another embodiment. The combustor 800 is substantially similar to the combustor 300 of FIG. 3 and is a rich dome combustor. The combustor 800 includes a secondary combustion chamber 830, however, that is different from the secondary combustion chamber 330 of FIG. 3.

The secondary combustion chamber 830 is defined by a forward wall 832, an aft wall 834, an axial wall 836, and a secondary combustion chamber opening 838. The secondary combustion chamber 830 also includes one or more secondary combustion chamber air holes 840 in the forward wall 832, the aft wall 834, and/or the axial wall 836. The combustor 800 includes the plurality of first mixing assemblies 312 including the pilot mixer 314 and the first fuel injector 318, and a plurality of second mixing assemblies 820 including a main mixer 822 and a second fuel injector 824. The plurality of second mixing assemblies 820 includes one or more secondary combustion chamber air swirlers 823, 825 for generating a secondary combustion chamber swirl air flow 842 within the second recirculation zone 302*b*. The one or more secondary combustion chamber air swirlers 823, 825 includes a first secondary combustion chamber air swirler 823 disposed through the aft wall 834 for swirling the compressed air 65 to aid in generating the secondary combustion chamber swirl air flow 842 within the second recirculation zone 302*b*, as detailed above. The one or more secondary combustion chamber air swirlers 823, 825 includes a second secondary combustion chamber air swirler 825 disposed through the forward wall 832 for generating the secondary combustion chamber swirl air flow 842. The main mixer 822 is positioned through the forward wall 832. In this way, the main mixer 822 injects a main fuel stream 870 of the fuel 67 axially forward within the second recirculation zone 302*b* of the secondary combustion chamber 830.

Figure 9:
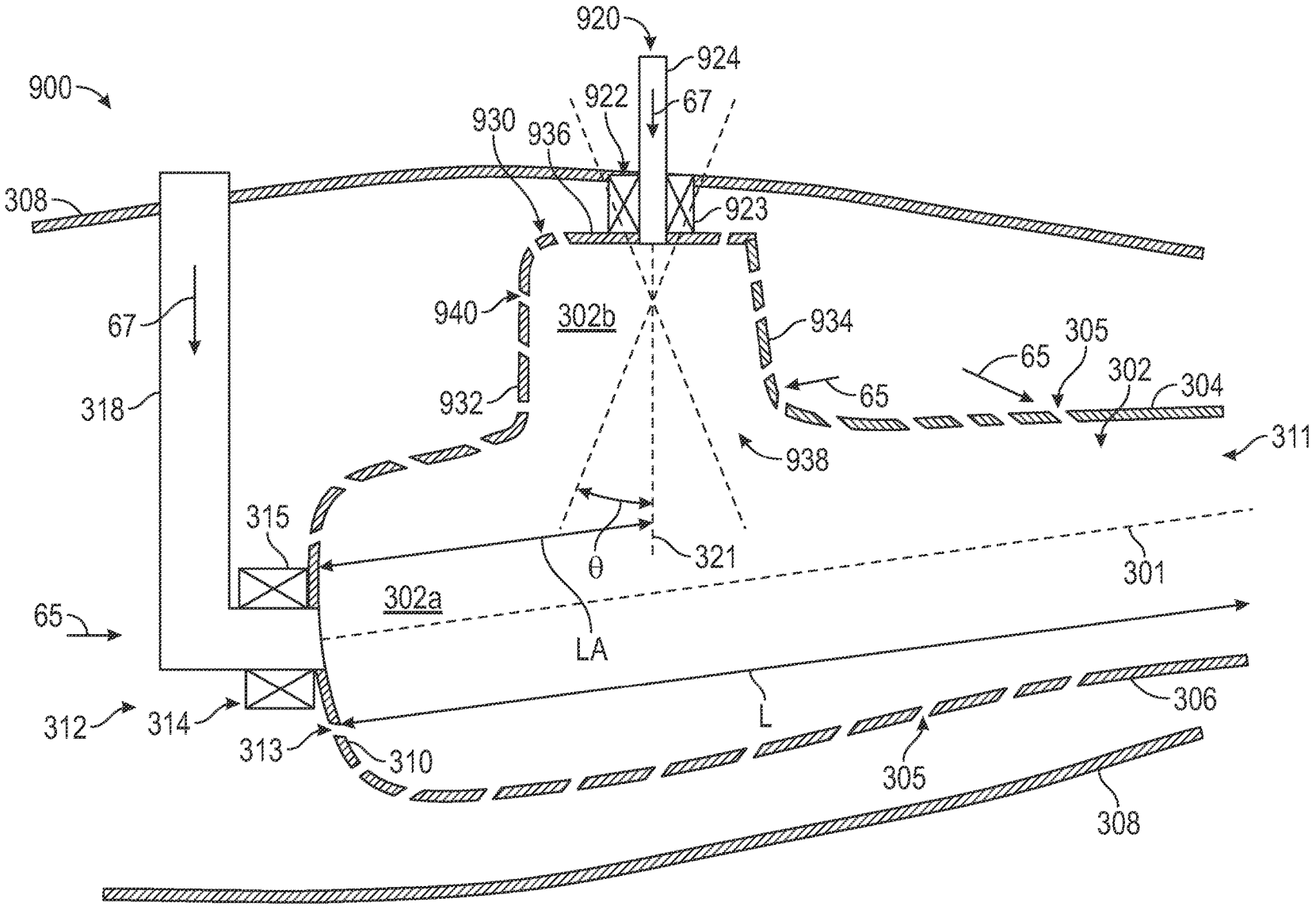
FIG. 9 is a schematic cross-sectional diagram of a combustor for a turbine engine, taken along a longitudinal centerline axis of the turbine engine, according to another embodiment.

FIG. 9 is a schematic cross-sectional diagram of a combustor 900 for a turbine engine, taken along a longitudinal centerline axis of the turbine engine, according to another embodiment. The combustor 900 is substantially similar to the combustor 300 of FIG. 3 and is a rich dome combustor. The combustor 900 includes a secondary combustion chamber 930, however, that is different from the secondary combustion chamber 330 of FIG. 3.

The secondary combustion chamber 930 is defined by a forward wall 932, an aft wall 934, an axial wall 936, and a secondary combustion chamber opening 938. The secondary combustion chamber 930 also includes one or more secondary combustion chamber air holes 940 in the forward wall 932, the aft wall 934, and/or the axial wall 936. The combustor 900 includes the plurality of first mixing assemblies 312 including the pilot mixer 314 and the first fuel injector 318, and a plurality of second mixing assemblies 920 including a main mixer 922 and a second fuel injector 924. The plurality of second mixing assemblies 920 includes one or more secondary combustion chamber air swirlers 923 for generating a secondary combustion chamber swirl air flow within the second recirculation zone 302*b*, as detailed above. The main mixer 922 is positioned through the axial wall 936. In this way, the main mixer 922 injects the main fuel stream of the fuel 67 radially inward within the second recirculation zone 302*b* of the secondary combustion chamber 930.

As shown in FIG. 9, the plurality of second mixing assemblies 920 are oriented at a first angle θ with respect to the radial direction R. As shown by the dashed lines, the first angle θ can be positive or negative such that the plurality of second mixing assemblies 920 (shown in dashed lines in a positive orientation and in a negative orientation) injects the fuel 67 into the secondary combustion chamber 930 at the first angle θ with respect to the radial direction R. The first angle θ is in a range from −60° to 60°. Such a range of the first angle θ provides for greater mixing of the combustion gases generated by the plurality of second mixing assemblies 920 and the combustion gases generated by the plurality of first mixing assemblies 312 as compared to values of the first angle θ that are outside (e.g., greater than or less than) the range.

The combustion chamber 302 includes a length L measured in the axial direction A from the annular dome 310 to the combustion chamber outlet 311. The plurality of second mixing assemblies 920 are disposed at an axial location on the combustion chamber 302. The plurality of second mixing assemblies 920 are disposed at an axial length $L_A$ measured from the annular dome 310 to a longitudinal centerline axis 321 of the plurality of second mixing assemblies 920. A ratio of the axial length $L_A$ to the length L of the combustion chamber 302 ($L_A/L$) is in a range of 0.2 to 0.8. Such a range of $L_A/L$ provides for an axial location of the plurality of second mixing assemblies 920 such that the combustion gases from the plurality of second mixing assemblies 920 adequately mix with the combustion gases from the plurality of first mixing assemblies 312 prior to entering the turbine section 27 (FIG. 1), while also being downstream from the plurality of first mixing assemblies 312 such that the combustion process generated by the plurality of second mixing assemblies 920 does not interfere with the combustion process of the plurality of first mixing assemblies 312.

Figure 10:
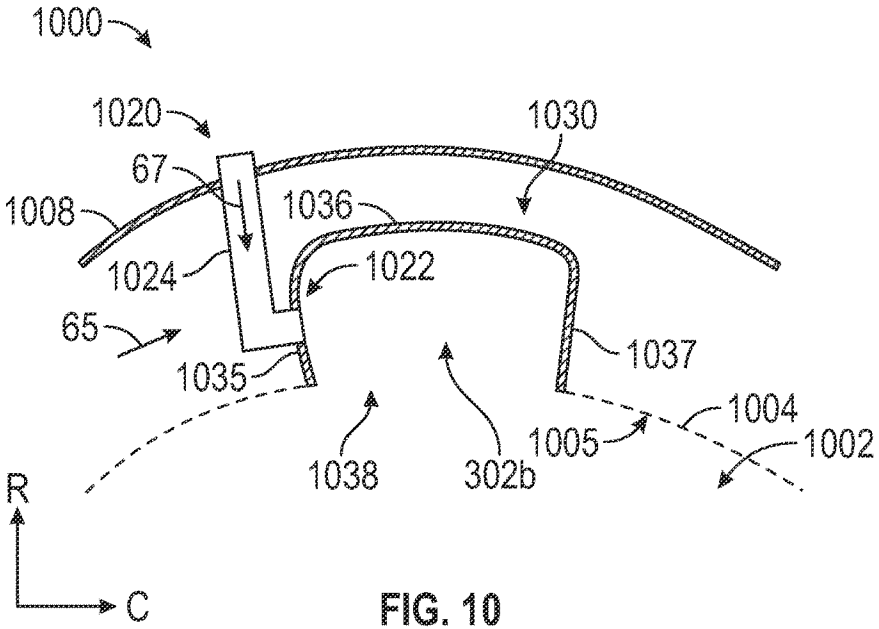
FIG. 10 is an enlarged, schematic cross-sectional view of a combustor, taken at a lateral centerline axis of a secondary combustion chamber of the combustor, according to another embodiment.

FIG. 10 is an enlarged, schematic cross-sectional view of a combustor 1000, taken at a lateral centerline axis of a secondary combustion chamber 1030 of the combustor 1000, according to another embodiment. The combustor 1000 is substantially similar to the combustor 300 of FIG. 3. The combustor 1000 includes a main combustion chamber 1002, an outer liner 1004 and an inner liner (not shown in FIG. 10) including one or more liner air holes 1005, an annular combustor casing 1008, an annular dome (not shown in FIG. 10), a plurality of first mixing assemblies (not shown in FIG. 10) including a pilot mixer (not shown in FIG. 10) and a first fuel injector (not shown in FIG. 10), a plurality of second mixing assemblies 1020 including a main mixer 1022 and a second fuel injector 1024, and a secondary combustion chamber 1030. The secondary combustion chamber 1030 is defined by a forward wall (not shown in FIG. 10), an aft wall (not shown in FIG. 10), an axial wall 1036, and a secondary combustion chamber opening 1038. The secondary combustion chamber 1030 is also defined by a first circumferential wall 1035 and a second circumferential wall 1037 that each extend axially from the forward wall to the aft wall.

The plurality of second mixing assemblies 1020 are positioned through the first circumferential wall 1035 such that the main mixer 1022 injects the main mixer fuel-air mixture circumferentially into the second recirculation zone 302*b* of the secondary combustion chamber 1030. In this way, the plurality of second mixing assemblies 1020 injects the main mixer fuel-air mixture in a first circumferential direction.

Figure 11:
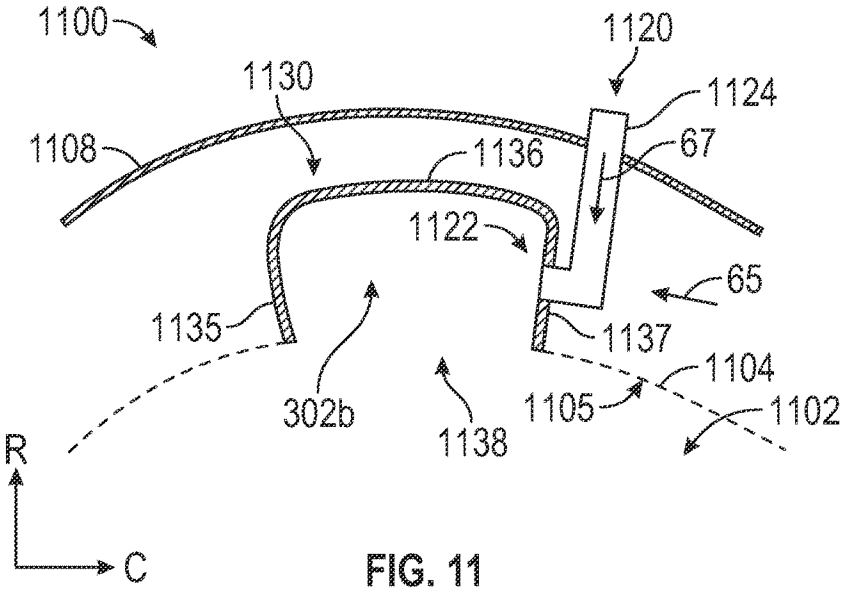
FIG. 11 is an enlarged, schematic cross-sectional view of a combustor, taken at a lateral centerline axis of a secondary combustion chamber of the combustor, according to another embodiment.

FIG. 11 is an enlarged, schematic cross-sectional view of a combustor 1100, taken at a lateral centerline axis of a secondary combustion chamber 1130 of the combustor 1100, according to another embodiment. The combustor 1100 is substantially similar to the combustors 300, 1000 of FIGS. 3 and 10, respectively. The combustor 1100 includes a main combustion chamber 1102, an outer liner 1104 and an inner liner (not shown in FIG. 11) including one or more liner air holes 1105, an annular combustor casing 1108, an annular dome (not shown in FIG. 11), a plurality of first mixing assemblies (not shown in FIG. 11) including a pilot mixer (not shown in FIG. 11) and a first fuel injector (not shown in FIG. 11), a plurality of second mixing assemblies 1120 including a main mixer 1122 and a second fuel injector 1124, and a secondary combustion chamber 1130. The secondary combustion chamber 1130 is defined by a forward wall (not shown in FIG. 11), an aft wall (not shown in FIG. 11), an axial wall 1136, and a secondary combustion chamber opening 1138. The secondary combustion chamber 1130 is also defined by a first circumferential wall 1135 and a second circumferential wall 1137 that each extends axially from the forward wall to the aft wall.

The plurality of second mixing assemblies 1120 are positioned through the second circumferential wall 1137 such that the main mixer 1122 injects the main mixer fuel-air mixture circumferentially into the second recirculation zone 302*b* of the secondary combustion chamber 1130. In this way, the plurality of second mixing assemblies 1120 injects the main mixer fuel-air mixture in a second circumferential direction that is opposite the first circumferential direction.

Figure 12:
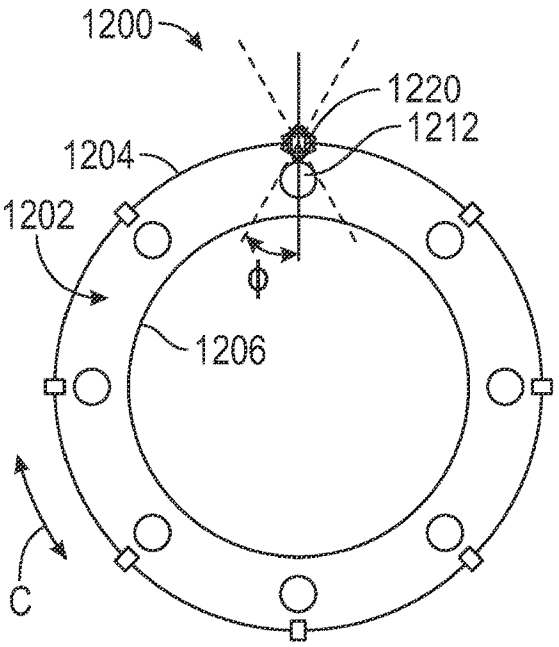
FIG. 12 is a schematic front view of a combustor, according to another embodiment.

FIG. 12 is a schematic front view of a combustor 1200, according to another embodiment. The combustor 1200 is substantially similar to the combustors 200, 300 of FIGS. 2 and 3, respectively. For example, the combustor 1200 includes a combustion chamber 1202, an outer liner 1204, an inner liner 1206, a plurality of first mixing assemblies 1212, and a plurality of second mixing assemblies 1220. The plurality of second mixing assemblies 1220 are oriented at a second angle $\phi$ with respect to the circumferential direction C. As shown by the dashed lines, the second angle $\phi$ can be positive or negative such that the plurality of second mixing assemblies 1220 injects the fuel at the second angle $\phi$ with respect to the circumferential direction C. The second angle $\phi$ is in a range from −80° to 80°. Such a range of the second angle $\phi$ provides for greater mixing of the combustion gases generated by the plurality of second mixing assemblies 1220 and the combustion gases generated by the plurality of first mixing assemblies 1212 as compared to values of the second angle $\phi$ that are outside (e.g., greater than or less than) the range.

Figure 13:
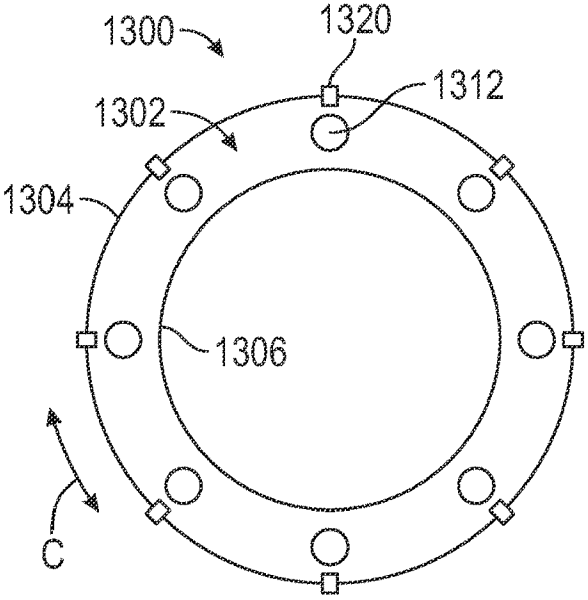
FIG. 13 is a schematic front view of a combustor, according to another embodiment.

FIG. 13 is a schematic front view of a combustor 1300, according to another embodiment. The combustor 1300 is substantially similar to the combustors 200, 300 of FIGS. 2 and 3, respectively. For example, the combustor 1300 includes a combustion chamber 1302, an outer liner 1304, an inner liner 1306, a plurality of first mixing assemblies 1312, and a plurality of second mixing assemblies 1320. As shown in FIG. 13, the plurality of first mixing assemblies 1312 and the plurality of second mixing assemblies 1320 are circumferentially aligned about the circumferential direction C. Aligning the plurality of first mixing assemblies 1312 and the plurality of second mixing assemblies 1320 circumferentially allows the combustion gases generated by the plurality of first mixing assemblies 1312 to mix with the combustion gases generated by the plurality of second mixing assemblies 1320 for a complete reaction prior to exiting the combustion chamber 1302.

Figure 14:
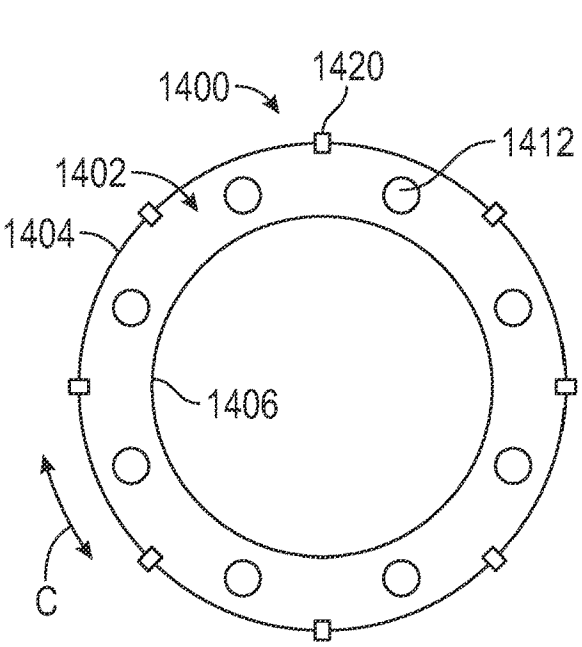
FIG. 14 is a schematic front view of a combustor, according to another embodiment.

FIG. 14 is a schematic front view of a combustor 1400, according to another embodiment. The combustor 1400 is substantially similar to the combustors 200, 300 of FIGS. 2 and 3, respectively. For example, the combustor 1400 includes a combustion chamber 1402, an outer liner 1404, an inner liner 1406, a plurality of first mixing assemblies 1412, and a plurality of second mixing assemblies 1420. As shown in FIG. 14, the plurality of first mixing assemblies 1412 and the plurality of second mixing assemblies 1420 are circumferentially misaligned about the circumferential direction C. Misaligning the plurality of first mixing assemblies 1412 and the plurality of second mixing assemblies 1420 circumferentially reduces the interaction of the plurality of first mixing assemblies 1412 and the plurality of second mixing assemblies 1420 so the combustion process of the plurality of second mixing assemblies 1420 does not interfere with the combustion process of the plurality of second mixing assemblies 1420.

Figure 15:
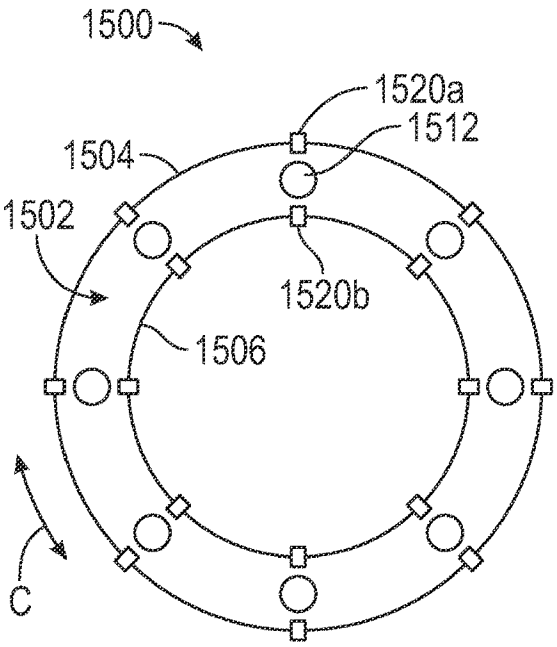
FIG. 15 is a schematic front view of a combustor, according to another embodiment.

FIG. 15 is a schematic front view of a combustor 1500, according to another embodiment. The combustor 1500 is substantially similar to the combustors 200, 300 of FIGS. 2 and 3, respectively. For example, the combustor 1500 includes a combustion chamber 1502, an outer liner 1504, an inner liner 1506, a plurality of first mixing assemblies 1512, a first plurality of second mixing assemblies 1520*a*, and a second plurality of second mixing assemblies 1520*b*. As shown in FIG. 15, the plurality of first mixing assemblies 1512, the first plurality of second mixing assemblies 1520*a*, and the second plurality of second mixing assemblies 1520*b* are circumferentially aligned about the circumferential direction C.

Figure 16:
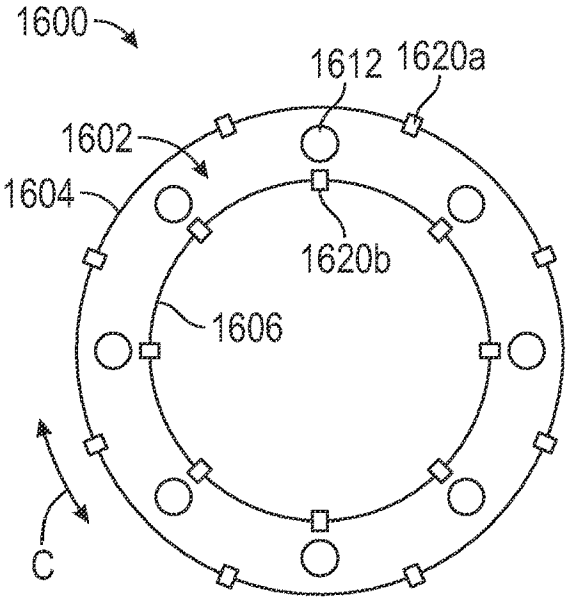
FIG. 16 is a schematic front view of a combustor, according to another embodiment.

FIG. 16 is a schematic front view of a combustor 1600, according to another embodiment. The combustor 1600 is substantially similar to the combustors 200, 300 of FIGS. 2 and 3, respectively. For example, the combustor 1600 includes a combustion chamber 1602, an outer liner 1604, an inner liner 1606, a plurality of first mixing assemblies 1612, a first plurality of second mixing assemblies 1620*a*, and a second plurality of second mixing assemblies 1620*b*. As shown in FIG. 16, the plurality of first mixing assemblies 1612 and the second plurality of second mixing assemblies 1620*b* are circumferentially aligned about the circumferential direction C, while the first plurality of second mixing assemblies 1620*a* are circumferentially misaligned with the first mixing assemblies 1612 and the second plurality of second mixing assemblies 1620*b*.

Figure 17:
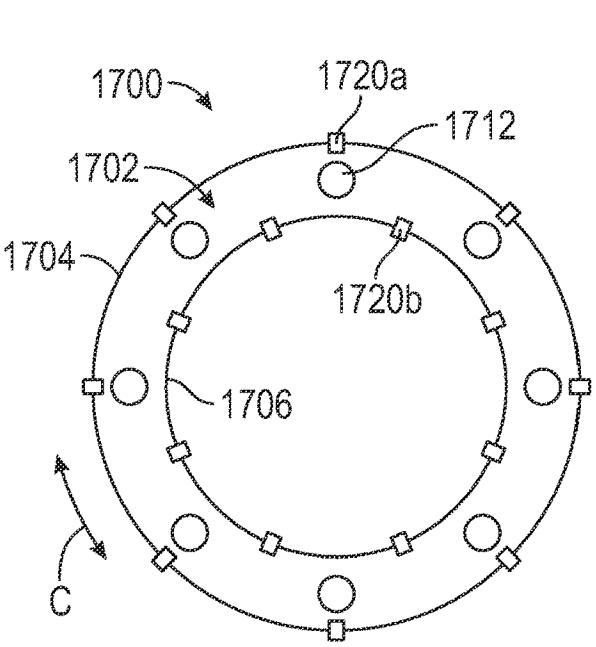
FIG. 17 is a schematic front view of a combustor, according to another embodiment.

FIG. 17 is a schematic front view of a combustor 1700, according to another embodiment. The combustor 1700 is substantially similar to the combustors 200, 300 of FIGS. 2 and 3, respectively. For example, the combustor 1700 includes a combustion chamber 1702, an outer liner 1704, an inner liner 1706, a plurality of first mixing assemblies 1712, a first plurality of second mixing assemblies 1720*a*, and a second plurality of second mixing assemblies 1720*b*. As shown in FIG. 17, the plurality of first mixing assemblies 1712 and the first plurality of second mixing assemblies 1720*a* are circumferentially aligned about the circumferential direction C, while the second plurality of second mixing assemblies 1720*b* are circumferentially misaligned with the first mixing assemblies 1712 and the first plurality of second mixing assemblies 1720*a*.

The embodiments detailed herein provide for a multi-staged combustor including radial staging and axial staging combined with one or more secondary combustion chambers that inject combustion gases downstream of a first recirculation zone, thereby, providing for improved stoichiometric capabilities in the combustor, while reducing $NO_x$ emissions, across the entire mission operating cycle of a turbine engine. The one or more secondary combustion chambers include a plurality of second mixing assemblies that each produces a second recirculation zone in the one or more secondary combustion chambers. Accordingly, the embodiments disclosed herein provide for greater $NO_x$ reductions, while allowing for leaner fuel-air ratios to the pilot mixer and the main mixer, as compared to combustors without the benefit of the present disclosure.

Further aspects of the present disclosure are provided by the subject matter of the following clauses.

A turbine engine comprises a combustor comprising a main combustion chamber including an outer liner and an inner liner, the main combustion chamber defining a radial direction, an axial direction, and a circumferential direction, an annular dome coupled to the outer liner and the inner liner at a forward end of the main combustion chamber, and a secondary combustion chamber formed in at least one of the outer liner or the inner liner and positioned downstream of the annular dome, and a plurality of first mixing assemblies each having a pilot mixer, the plurality of first mixing assemblies disposed through the annular dome, the pilot mixer operably injecting a pilot mixer fuel-air mixture axially into the main combustion chamber and generating a first recirculation zone within the main combustion chamber, and a plurality of second mixing assemblies each having a main mixer, the plurality of second mixing assemblies disposed through the outer liner or the inner liner of the secondary combustion chamber and axially aft of the plurality of first mixing assemblies, the main mixer operably injecting a main mixer fuel-air mixture into the secondary combustion chamber to produce combustion gases and generating a second recirculation zone within the secondary combustion chamber, the second recirculation zone being axially aft of, and separate from, the first recirculation zone, and the secondary combustion chamber operably injecting the combustion gases into the main combustion chamber.

The turbine engine of the preceding clause, the plurality of first mixing assemblies including a first main mixer, the first main mixer operably injecting a first main mixer fuel-air mixture radially into the first recirculation zone of the main combustion chamber.

The turbine engine of any preceding clause, the plurality of first mixing assemblies including a main combustion chamber air swirler, the main combustion chamber air swirler operably swirling compressed air and generating the first recirculation zone within the main combustion chamber.

The turbine engine of any preceding clause, the plurality of second mixing assemblies including one or more secondary combustion chamber air swirlers, the one or more secondary combustion chamber air swirlers operably swirling compressed air and generating the second recirculation zone within the secondary combustion chamber.

The turbine engine of any preceding clause, the secondary combustion chamber being defined by a forward wall, an aft wall, and an axial wall that extends from the forward wall to aft wall, the forward wall and the aft wall extending generally radially outward from the outer liner or radially inward from the inner liner.

The turbine engine of any preceding clause, the main combustion chamber including a main combustion chamber volume and the secondary combustion chamber including a secondary combustion chamber volume, the secondary combustion chamber volume being 10% to 80% of the main combustion chamber volume.

The turbine engine of any preceding clause, the combustion chamber including a length L in the axial direction measured from the annular dome to a combustion chamber outlet, the main mixer being disposed on the outer liner or the inner liner at an axial length $L_A$ measured from the annular dome to a longitudinal centerline axis of the second main mixer, and a ratio ($L/L_A$) of the length L of the combustion chamber to the axial length $L_A$ of the second main mixer being in a range from 0.2 to 0.8.

The turbine engine of any preceding clause, the main mixer being disposed at a first angle θ with respect to the radial direction, the first angle θ being in a range from −60° to 60°, and the main mixer being disposed at a second angle ϕ with respect to the circumferential direction, the second angle ϕ being in a range from −80° to 80°.

The turbine engine of any preceding clause, further comprising a fuel system that operably provides fuel splits to the pilot mixer and the main mixer such that the pilot mixer being fuel-rich and the main mixer being fuel-lean.

The turbine engine of any preceding clause, the fuel system operably provides the fuel to the pilot mixer and the main mixer such that the pilot mixer or the pilot mixer and the main mixer operate at a low power operation of the turbine engine, and the pilot mixer and the main mixer operate at a mid-level power operation or a high power operation of the turbine engine.

The turbine engine of any preceding clause, the secondary combustion chamber including one or more air holes that operably direct compressed air into the secondary combustion chamber to cool the forward wall, the aft wall, and/or the axial wall.

The turbine engine of any preceding clause, the pilot mixer fuel-air mixture being ignited to generate a first flame within the first recirculation zone.

The turbine engine of any preceding clause, the main mixer fuel-air mixture being ignited to generate a main flame within the second recirculation zone of the secondary combustion chamber.

The turbine engine of any preceding clause, the first flame producing combustion gases within the first combustion zone.

The turbine engine of any preceding clause, the main combustion chamber operably directing the combustion gases from the first recirculation zone downstream to mix with the combustion gases from the secondary combustion chamber within the main combustion chamber.

The turbine engine of any preceding clause, the main combustion chamber extending from the annular dome to a main combustion chamber outlet.

The turbine engine of any preceding clause, the plurality of first mixing assemblies being spaced circumferentially about the annular dome.

The turbine engine of any preceding clause, each first mixing assembly being a twin annular premixing swirler (TAPS).

The turbine engine of any preceding clause, further comprising a plurality of first fuel injectors each coupled in flow communication with a respective first mixing assembly.

The turbine engine of any preceding clause, the plurality of second mixing assemblies being spaced circumferentially about the outer liner or the inner liner.

The turbine engine of any preceding clause, further comprising a plurality of second fuel injectors each coupled in flow communication with a respective second mixing assembly.

The turbine engine of any preceding clause, low power operation being less than 30% of sea level static (SLS) maximum engine rated thrust.

The turbine engine of any preceding clause, mid-level power operation being from 30% to 85% of the SLS maximum engine rated thrust.

The turbine engine of any preceding clause, high power operation being greater than 85% of the SLS maximum engine rated thrust.

The turbine engine of any preceding clause, the plurality of mixing assemblies swirling the pilot mixer fuel-air mixture in a first swirl direction.

The turbine engine of any preceding clause, the main mixer swirling the main mixer fuel-air mixture in a second swirl direction.

The turbine engine of any preceding clause, the second swirl direction being the same as the first swirl direction.

The turbine engine of any preceding clause, the second swirl direction being different from the first swirl direction.

The turbine engine of any preceding clause, the combustor operably directing a first portion of compressed air to the pilot mixer and a second portion of compressed air to the main mixer.

The turbine engine of any preceding clause, the first portion of compressed air including 12% to 20% of the compressed air provided to the pilot mixer, and the second portion of compressed air including 15% to 30% of the compressed air provided to the main mixer.

The turbine engine of any preceding clause, the first portion of compressed air including 12% to 20% of the compressed air provided to the pilot mixer, and the second portion of compressed air including 45% to 65% of the compressed air provided to the main mixer.

The turbine engine of any preceding clause, the combustor operably directing a first portion of compressed air to the pilot mixer, a second portion of compressed air to the first main mixer, and a third portion of compressed air to the second main mixer.

The turbine engine of any preceding clause, the first portion of compressed air including 7% to 20% of the compressed air provided to the pilot mixer, the second portion of compressed air including 30% to 60% of the compressed air provided to the pilot mixer, and the third portion of compressed air including 11% to 30% of the compressed air provided to the second main mixer.

The turbine engine of any preceding clause, the pilot mixer generating a pilot fuel stream such that the pilot fuel-air mixture being fuel-rich, the first main mixer generating a first main fuel stream such that the first main mixer fuel-air mixture being fuel-lean, and the second main mixer generating a second main fuel stream such that the second main mixer fuel-air mixture being more fuel-lean than the first main mixer fuel-air mixture.

The turbine engine of any preceding clause, the pilot fuel stream including 90% to 100% of the fuel during idle conditions of the turbine engine, 35% to 50% of the fuel during approach conditions of the turbine engine, 20% to 40% of the fuel during cruise conditions of the turbine engine, and 5% to 20% of the fuel during climb conditions or take-off conditions of the turbine engine.

The turbine engine of any preceding clause, the first main fuel stream including 0% to 5% of the fuel during idle conditions of the turbine engine, 50% to 58% of the fuel during approach conditions of the turbine engine, 55% to 70% of the fuel during cruise conditions of the turbine engine, and 65% to 72% of the fuel during climb conditions or take-off conditions of the turbine engine.

The turbine engine of any preceding clause, the second main fuel stream including 0% to 5% of the fuel during idle conditions of the turbine engine, 0% to 7% of the fuel during approach conditions of the turbine engine, 5% to 10% of the fuel during cruise conditions of the turbine engine, and 15% to 23% of the fuel during climb conditions or take-off conditions of the turbine engine.

The turbine engine of any preceding clause, the combustor operably directing a first portion of compressed air to the pilot mixer, and a second portion of compressed air to the main mixer.

The turbine engine of any preceding clause, the pilot mixer generating a pilot fuel stream such that the pilot fuel-air mixture being fuel-rich, and the main mixer generating a main fuel stream such that the main mixer fuel-air mixture being fuel-lean.

The turbine engine of any preceding clause, the pilot fuel stream including 95% to 100% of the fuel during idle conditions, approach conditions, and cruise conditions of the turbine engine, and 65% to 80% of the fuel during climb conditions and take-off conditions of the turbine engine.

The turbine engine of any preceding clause, the main fuel stream including 0% to 5% of the fuel during idle conditions, approach conditions, and cruise conditions of the turbine engine, and 20% to 35% of the fuel during climb conditions and take-off conditions.

The turbine engine of any preceding clause, the pilot fuel stream including 80% to 100% of the fuel during idle conditions, 40% to 100% of the fuel during approach conditions, and 15% to 50% of the fuel during cruise conditions, climb conditions, and take-off conditions.

The turbine engine of any preceding clause, the main fuel stream including 0% to 20% of the fuel during idle conditions, 0% to 60% of the fuel during approach conditions, and 50% to 85% cruise conditions, climb conditions, and take-off conditions.

The turbine engine of any preceding clause, the combustor operably directing the compressed air through the annular dome, through the outer liner and the inner liner in an area forward of the plurality of second mixing assemblies, and through the outer liner and the inner liner in an area aft of the plurality of second mixing assemblies.

The turbine engine of any preceding clause, the combustor operably directing 5% to 9% of the compressed air to the annular dome, 7% to 10% of the compressed air to the outer liner and the inner liner in the area forward of the plurality of second mixing assemblies, and 6% to 9% of the compressed air to the outer liner and the inner liner in an area aft of the plurality of second mixing assemblies.

The turbine engine of any preceding clause, the combustor operably directing 5% to 9% of the compressed air to the annular dome, 35% to 50% of the compressed air to one or more combustion air holes on the outer liner or the inner liner, 7% to 10% of the compressed air to the outer liner and the inner liner in the area forward of the plurality of second mixing assemblies, and 6% to 9% of the compressed air to the outer liner and the inner liner in an area aft of the plurality of second mixing assemblies.

The turbine engine of any preceding clause, the combustor operably directing 5% to 9% of the compressed air to the annular dome, 5% to 15% of the compressed air to one or more dilution holes on the outer liner or the inner liner, 7% to 9% of the compressed air to the outer liner and the inner liner in the area forward of the plurality of second mixing assemblies, and 7% to 9% of the compressed air to the outer liner and the inner liner in an area aft of the plurality of second mixing assemblies.

The turbine engine of any preceding clause, the annular dome including one or more annular dome air holes to provide the compressed air through the annular dome into the combustion chamber.

The turbine engine of any preceding clause, the outer liner including one or more liner air holes to provide the compressed air through the outer liner into the combustion chamber.

The turbine engine of any preceding clause, the inner liner including one or more liner air holes to provide the compressed air through the outer liner into the combustion chamber.

The turbine engine of any preceding clause, the plurality of first mixing assemblies and the plurality of second mixing assemblies being circumferentially aligned about the circumferential direction.

The turbine engine of any preceding clause, the plurality of first mixing assemblies and the plurality of second mixing assemblies being circumferentially misaligned about the circumferential direction.

The turbine engine of any preceding clause, the plurality of second mixing assemblies including a first plurality of mixing assemblies on the outer liner and a second plurality of second mixing assemblies on the inner liner.

The turbine engine of any preceding clause, the plurality of first mixing assemblies, the first plurality of second mixing assemblies, and the second plurality of second mixing assemblies being circumferentially aligned about the circumferential direction.

The turbine engine of any preceding clause, the plurality of first mixing assemblies and the second plurality of second mixing assemblies being circumferentially aligned about the circumferential direction, and the first plurality of second mixing assemblies being circumferentially misaligned about the circumferential direction with the plurality of first mixing assemblies and the second plurality of second mixing assemblies.

The turbine engine of any preceding clause, the plurality of first mixing assemblies and the first plurality of second mixing assemblies being circumferentially aligned about the circumferential direction, and the second plurality of second mixing assemblies being circumferentially misaligned about the circumferential direction with the plurality of first mixing assemblies and the first plurality of second mixing assemblies.

The turbine engine of any preceding clause, the one or more secondary combustion chamber air swirlers including a first secondary combustion chamber air swirler and a second secondary combustion chamber air swirler.

The turbine engine of any preceding clause, the first secondary combustion chamber air swirler being positioned through the forward wall.

The turbine engine of any preceding clause, the first secondary combustion chamber air swirler being positioned through the aft wall.

The turbine engine of any preceding clause, the second secondary combustion chamber air swirler being positioned through the forward wall.

The turbine engine of any preceding clause, the second secondary combustion chamber air swirler being positioned through the aft wall.

The turbine engine of any preceding clause, the plurality of second mixing assemblies operably injecting the main fuel stream at an aft stagnation region of the second recirculation zone.

The turbine engine of any preceding clause, the secondary combustion chamber including one or more combustion air holes disposed in at least one of the forward wall, the aft wall, or the axial wall that operably direct compressed air into the secondary combustion chamber for additional air for combustion.

The turbine engine of any preceding clause, the main mixer being disposed through the aft wall and operably injecting the main mixer fuel-air mixture axially forward into the secondary combustion chamber.

The turbine engine of any preceding clause, the main mixer being disposed through the forward wall and operably injecting the main mixer fuel-air mixture axially aft into the secondary combustion chamber.

The turbine engine of any preceding clause, the main mixer being disposed through the axial wall and operably injecting the main mixer fuel-air mixture radially into the secondary combustion chamber.

The turbine engine of any preceding clause, the secondary combustion chamber including one or more secondary combustion chamber air holes disposed in at least one of the forward wall, the aft wall, or the axial wall for cooling the forward wall, the aft wall, or the axial wall.

The turbine engine of any preceding clause, the secondary combustion chamber being defined by a first circumferential wall and a second circumferential wall extending axially from the forward wall to the aft wall.

The turbine engine of any preceding clause, the main mixer being disposed through the first circumferential wall and operably injecting the main mixer fuel-air mixture circumferentially into the secondary combustion chamber in a first circumferential direction.

The turbine engine of any preceding clause, the main mixer being disposed through the second circumferential wall and operably injecting the main mixer fuel-air mixture circumferentially into the secondary combustion chamber in a second circumferential direction that being opposite the first circumferential direction.

A combustor for a turbine engine, the turbine engine being the turbine engine of any preceding clause.

A method of operating the turbine engine of any preceding clause, the method comprising generating the pilot mixer fuel-air mixture with the pilot mixer, injecting the pilot mixer fuel-air mixture axially into the main combustion chamber and generating the first recirculation zone to generate a pilot flame that produces combustion gases within the first recirculation zone, generating the main mixer fuel-air mixture with the main mixer, injecting the main mixer fuel-air mixture into the secondary combustion chamber and generating the second recirculation zone to generate a main flame that produces combustion gases within the secondary combustion chamber, and injecting the combustion gases from the secondary combustion chamber into the main combustion chamber downstream of the first recirculation zone.

The method of the proceeding clause, further comprising operably directing the combustion gases in the first recirculation zone downstream from the first recirculation zone, and mixing the combustion gases from the first recirculation zone with the combustion gases from the secondary combustion chamber in the main combustion chamber.

The method of any preceding clause, further comprising operably directing a first portion of compressed air to the pilot mixer and a second portion of compressed air to the main mixer.

The method of any preceding clause, further comprising generating a pilot fuel stream with the pilot mixer such that the pilot mixer fuel-air mixture being fuel-rich, and generating a main fuel stream with the main mixer such that the main mixer fuel-air mixture being fuel-lean.

The method of any preceding clause, further comprising generating a first main mixer fuel-air mixture with a first main mixer of the plurality of first mixing assemblies, and injecting the first main mixer fuel-air mixture radially into the first recirculation zone of the main combustion chamber.

The method of any preceding clause, further comprising swirling compressed air with a main combustion chamber air swirler to generate the first recirculation zone.

The method of any preceding clause, further comprising swirling compressed air with one or more secondary combustion chamber air swirlers to generate the second recirculation zone.

The method of any preceding clause, further comprising operating the pilot mixer and the main mixer during a mid-level power operation or a high power operation of the turbine engine.

The method of any preceding clause, further comprising operating the pilot mixer during a low power operation of the turbine engine.

The method of any preceding clause, further comprising operating the pilot mixer and the main mixer during a low power operation of the turbine engine.

The method of any preceding clause, the turbine engine being the turbine engine of any preceding clause.

Although the foregoing description is directed to the preferred embodiments of the present disclosure, other variations and modifications will be apparent to those skilled in the art and may be made without departing from the spirit or the scope of the disclosure. Moreover, features described in connection with one embodiment of the present disclosure may be used in conjunction with other embodiments, even if not explicitly stated above.

The invention claimed is:

1. A turbine engine comprising:

a combustor comprising:

a main combustion chamber including an outer liner and an inner liner, the main combustion chamber defining a radial direction, an axial direction, and a circumferential direction;

an annular dome coupled to the outer liner and the inner liner at a forward end of the main combustion chamber; and a secondary combustion chamber formed in at least one of the outer liner or the inner liner and positioned downstream of the annular dome, wherein the secondary combustion chamber is a cavity in the outer liner or the inner liner, and the outer liner and the inner liner extend aft of the secondary combustion chamber and forward of the secondary combustion chamber, and wherein the secondary combustion chamber is defined by a forward wall, an aft wall, and an axial wall that extends from the forward wall to the aft wall, the forward wall being positioned forward of the axial wall, the aft wall extending substantially perpendicular along the radial direction from a downstream portion of the outer liner to the axial wall or substantially perpendicular along the radial direction from a downstream portion of the inner liner to the axial wall;

a plurality of first mixing assemblies each having a pilot mixer, the plurality of first mixing assemblies disposed through the annular dome, the pilot mixer configured to inject a pilot mixer fuel-air mixture axially into the main combustion chamber to generate a first recirculation zone within the main combustion chamber; and a plurality of second mixing assemblies each having a main mixer, the plurality of second mixing assemblies disposed through the outer liner or the inner liner at the secondary combustion chamber and axially aft of the plurality of first mixing assemblies, the main mixer configured to inject a main mixer fuel-air mixture into the secondary combustion chamber to produce combustion gases and to generate a second recirculation zone within the secondary combustion chamber, the second recirculation zone being axially aft of, and separate from, the first recirculation zone, and the secondary combustion chamber configured to inject the combustion gases into the main combustion chamber.

2. The turbine engine of claim 1, wherein the plurality of first mixing assemblies includes a first main mixer, the first main mixer configured to inject a first main mixer fuel-air mixture radially into the first recirculation zone of the main combustion chamber.

3. The turbine engine of claim 1, wherein the plurality of first mixing assemblies includes a main combustion chamber air swirler, the main combustion chamber air swirler configured to swirl compressed air to generate the first recirculation zone within the main combustion chamber.

4. The turbine engine of claim 1, wherein the plurality of second mixing assemblies includes one or more secondary combustion chamber air swirlers, the one or more secondary combustion chamber air swirlers configured to swirl compressed air to generate the second recirculation zone within the secondary combustion chamber.

5. The turbine engine of claim 1, wherein the forward wall extends radially outward from the outer liner or radially inward from the inner liner.

6. The turbine engine of claim 1, wherein the main combustion chamber includes a main combustion chamber volume and the secondary combustion chamber includes a secondary combustion chamber volume, the secondary combustion chamber volume being 10% to 80% of the main combustion chamber volume.

7. The turbine engine of claim 1, wherein the main combustion chamber includes a length L in the axial direction measured from the annular dome to a combustion chamber outlet, the main mixer being disposed on the outer liner or the inner liner at an axial length $L_A$ measured from the annular dome to a longitudinal centerline axis of the main mixer, and a ratio ($L/L_A$) of the length L of the main combustion chamber to the axial length $L_A$ of the main mixer is in a range from 0.2 to 0.8.

8. The turbine engine of claim 1, wherein the main mixer is disposed at a first angle θ with respect to the radial direction, the first angle θ being in a range from −60° to 60°, and the main mixer is disposed at a second angle q with respect to the circumferential direction, the second angle q being in a range from −80° to 80°.

9. The turbine engine of claim 1, further comprising a fuel system that provides fuel splits to the pilot mixer and the main mixer such that the pilot mixer is fuel-rich and the main mixer is fuel-lean.

10. The turbine engine of claim 9, wherein the fuel system provides the fuel to the pilot mixer and the main mixer such that the pilot mixer or the pilot mixer and the main mixer operate at a low power operation of the turbine engine, and the pilot mixer and the main mixer operate at a mid-level power operation or a high power operation of the turbine engine.

11. A method of operating the turbine engine of claim 1, the method comprising:

generating the pilot mixer fuel-air mixture with the pilot mixer;

injecting the pilot mixer fuel-air mixture axially into the main combustion chamber and generating the first recirculation zone to generate a pilot flame that produces combustion gases within the first recirculation zone;

generating the main mixer fuel-air mixture with the main mixer;

injecting the main mixer fuel-air mixture into the secondary combustion chamber and generating the second recirculation zone to generate a main flame that produces combustion gases within the secondary combustion chamber; and injecting the combustion gases from the secondary combustion chamber into the main combustion chamber downstream of the first recirculation zone.

12. The method of claim 11, further comprising directing the combustion gases in the first recirculation zone downstream from the first recirculation zone, and mixing the combustion gases from the first recirculation zone with the combustion gases from the secondary combustion chamber in the main combustion chamber.

13. The method of claim 11, further comprising directing a first portion of compressed air to the pilot mixer and a second portion of compressed air to the main mixer.

14. The method of claim 11, further comprising generating a pilot fuel stream with the pilot mixer such that the pilot mixer fuel-air mixture is fuel-rich, and generating a main fuel stream with the main mixer such that the main mixer fuel-air mixture is fuel-lean.

15. The method of claim 11, further comprising generating a first main mixer fuel-air mixture with a first main mixer of the plurality of first mixing assemblies, and injecting the first main mixer fuel-air mixture radially into the first recirculation zone of the main combustion chamber.

16. The method of claim 11, further comprising swirling compressed air with a main combustion chamber air swirler to generate the first recirculation zone.

17. The method of claim 11, further comprising swirling compressed air with one or more secondary combustion chamber air swirlers to generate the second recirculation zone.

18. The method of claim 11, further comprising operating the pilot mixer and the main mixer during a mid-level power operation or a high power operation of the turbine engine.

19. The method of claim 18, further comprising operating the pilot mixer during a low power operation of the turbine engine.

20. The method of claim 18, further comprising operating the pilot mixer and the main mixer during a low power operation of the turbine engine.

* * * * *